US009464443B2

(12) United States Patent
Martensson

(10) Patent No.: US 9,464,443 B2
(45) Date of Patent: Oct. 11, 2016

(54) FLOORING MATERIAL COMPRISING FLOORING ELEMENTS WHICH ARE ASSEMBLED BY MEANS OF SEPARATE FLOORING ELEMENTS

(71) Applicant: PERGO (EUROPE) AB, Trelleborg (SE)

(72) Inventor: Goran Martensson, Klagstorp (SE)

(73) Assignee: PERGO (EUROPE) AB, Trelleborg (SE)

( * ) Notice: Subject to any disclaimer, the term of this patent is extended or adjusted under 35 U.S.C. 154(b) by 0 days.

(21) Appl. No.: 14/086,757

(22) Filed: Nov. 21, 2013

(65) Prior Publication Data

US 2014/0157700 A1 Jun. 12, 2014

Related U.S. Application Data

(60) Continuation of application No. 11/185,724, filed on Jul. 21, 2005, now abandoned, which is a division of application No. 10/802,779, filed on Mar. 18, 2004, now Pat. No. 6,920,732, which is a division of application No. 09/806,994, filed as application No. PCT/SE99/01699 on Sep. 27, 1999, now Pat. No. 6,763,643.

(30) Foreign Application Priority Data

Oct. 6, 1998 (SE) ..... 9803379-8

(51) Int. Cl.
*E04F 15/02* (2006.01)
*E04F 15/04* (2006.01)
*E04F 15/10* (2006.01)

(52) U.S. Cl.
CPC ..... *E04F 15/02038* (2013.01); *E04F 15/02* (2013.01); *E04F 15/04* (2013.01);

(Continued)

(58) Field of Classification Search
CPC ..... E04F 15/04; E04F 2201/0115; E04F 2201/05; E04F 15/02005; E04F 2201/049
USPC ..... 52/395, 463, 471, 586.1, 586.2
See application file for complete search history.

(56) References Cited

U.S. PATENT DOCUMENTS 87,853 A 3/1869 Kappes
108,068 A 10/1870 Utley (Continued)

FOREIGN PATENT DOCUMENTS

AT 000 112 U2 2/1995
AT 002 214 U1 6/1998

(Continued)

OTHER PUBLICATIONS

Knight's American Mechanical Dictionary, vol. III. 1876, definition of scarf.

(Continued)

*Primary Examiner* — Elizabeth A Quast
(74) *Attorney, Agent, or Firm* — Jenkins, Wilson, Taylor & Hunt, P.A.

(57) ABSTRACT

Flooring material comprising board shaped floor elements with a rectangular oblong shape, which are provided with edges, a lower side and a decorative upper surface. The flooring material further includes joining profiles separate from the basic material of the floor elements. The floor elements may become fixed adjacent to each other, wherein the fixation is effective both horizontally and vertically. The vertical fixation is obtained through at least one of the joining profiles, which is not involved in the horizontal fixation.

18 Claims, 5 Drawing Sheets

(52) U.S. Cl.
CPC ..... *E04F 15/102* (2013.01); *E04F 2201/0115* (2013.01); *E04F 2201/0138* (2013.01); *E04F 2201/028* (2013.01); *E04F 2201/0517* (2013.01); *E04F 2201/0529* (2013.01)

(56) References Cited

U.S. PATENT DOCUMENTS

| | | | |
|---|---|---|---|
| 208,036 | A | 9/1878 | Robley |
| 213,740 | A | 4/1879 | Conner |
| 274,354 | A | 3/1883 | McCarthy et al. |
| 308,313 | A | 11/1884 | Gerike |
| 338,653 | A | 5/1886 | Whitmore |
| 342,529 | A | 5/1886 | McRae |
| 502,289 | A | 8/1893 | Feldman |
| 662,458 | A | 11/1900 | Nagel |
| 713,577 | A | 11/1902 | Wickham |
| 714,987 | A | 12/1902 | Wolfe |
| 752,694 | A | 2/1904 | Lund |
| 753,791 | A | 3/1904 | Fulghum |
| 769,355 | A | 9/1904 | Platow |
| 832,003 | A | 9/1906 | Torrence |
| 847,272 | A | 3/1907 | Ayers |
| 877,639 | A | 1/1908 | Galbraith |
| 890,436 | A | 6/1908 | Momberg |
| 898,381 | A | 9/1908 | Mattison |
| 1,000,859 | A | 8/1911 | Vaughan |
| 1,002,102 | A | 8/1911 | Weedon |
| 1,016,383 | A | 2/1912 | Wellman |
| 1,078,776 | A | 11/1913 | Dunton |
| 1,097,986 | A | 5/1914 | Moritz |
| 1,124,226 | A | 1/1915 | Houston |
| 1,124,228 | A | 1/1915 | Houston |
| 1,137,197 | A | 4/1915 | Ellis |
| 1,140,958 | A | 5/1915 | Cowan |
| 1,201,285 | A | 10/1916 | Gray |
| 1,266,253 | A | 5/1918 | Hakason |
| 1,319,286 | A | 10/1919 | Johnson et al. |
| 1,357,713 | A | 11/1920 | Lane |
| 1,371,856 | A | 3/1921 | Cade |
| 1,407,679 | A | 2/1922 | Ruchrauff |
| 1,411,415 | A | 4/1922 | Cooley |
| 1,436,858 | A | 11/1922 | Reinhart |
| 1,454,250 | A | 5/1923 | Parsons |
| 1,468,288 | A | 9/1923 | Fen |
| 1,510,924 | A | 10/1924 | Daniels et al. |
| 1,540,128 | A | 6/1925 | Houston |
| 1,575,821 | A | 3/1926 | Daniels |
| 1,576,527 | A | 3/1926 | McBride |
| 1,576,821 | A | 3/1926 | Daniels |
| 1,602,256 | A | 10/1926 | Sellin |
| 1,602,267 | A | 10/1926 | Karwisde |
| 1,615,096 | A | 1/1927 | Myers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,657,159 | A | 1/1928 | Greenebaum |
| 1,660,480 | A | 2/1928 | Daniels |
| 1,706,924 | A | 3/1929 | Kane |
| 1,714,738 | A | 5/1929 | Smith |
| 1,718,702 | A | 6/1929 | Pfiester |
| 1,723,306 | A | 8/1929 | Sipe |
| 1,734,826 | A | 11/1929 | Pick |
| 1,736,539 | A | 11/1929 | Lachman |
| 1,743,492 | A | 1/1930 | Sipe |
| 1,764,331 | A | 6/1930 | Moratz |
| 1,772,417 | A | 8/1930 | Ellinwood |
| 1,776,188 | A | 9/1930 | Langbaum |
| 1,823,039 | A | 9/1930 | Gruner |
| 1,778,069 | A | 10/1930 | Fetz |
| 1,787,027 | A | 12/1930 | Wasleff |
| 1,801,093 | A | 4/1931 | Larkins |
| 1,843,024 | A | 1/1932 | Werner |
| 1,854,396 | A | 4/1932 | Davis |
| 1,859,667 | A | 5/1932 | Gruner |
| 1,864,774 | A | 6/1932 | Storm |
| 1,477,813 | A | 12/1932 | Daniels et al. |
| 1,898,364 | A | 2/1933 | Gynn |
| 1,906,411 | A | 5/1933 | Potvin |
| 1,913,342 | A | 6/1933 | Schaffert |
| 1,929,871 | A | 10/1933 | Jones |
| 1,940,377 | A | 12/1933 | Storm |
| 1,946,646 | A | 2/1934 | Storm |
| 1,953,306 | A | 4/1934 | Moratz |
| 1,966,020 | A | 7/1934 | Rowley |
| 1,978,075 | A | 10/1934 | Butterworth |
| 1,986,739 | A | 1/1935 | Mitte |
| 1,988,201 | A | 1/1935 | Hall |
| 1,991,701 | A | 2/1935 | Roman |
| 2,004,193 | A | 6/1935 | Cherry |
| 2,015,813 | A | 10/1935 | Nielsen |
| 2,027,292 | A | 1/1936 | Rockwell |
| 2,044,216 | A | 6/1936 | Klages |
| 2,045,067 | A | 6/1936 | Bruce |
| 2,049,571 | A | 8/1936 | Schuck |
| 2,088,405 | A | 7/1937 | Cahn |
| 2,100,238 | A | 11/1937 | Burgess |
| RE20,816 | E | 8/1938 | Haase |
| 2,126,956 | A | 8/1938 | Gilbert |
| 2,138,085 | A | 11/1938 | Birtles |
| 2,141,708 | A | 12/1938 | Elmendorf |
| 2,142,305 | A | 1/1939 | Davis |
| 2,194,086 | A | 3/1940 | Horn |
| 2,199,938 | A | 5/1940 | Kloote |
| 2,222,137 | A | 11/1940 | Bruce |
| 2,226,540 | A | 12/1940 | Boettcher |
| 2,238,169 | A | 4/1941 | Heyn et al. |
| 2,245,497 | A | 6/1941 | Potchen |
| 2,253,943 | A | 8/1941 | Rice |
| 2,261,897 | A | 11/1941 | Adams |
| 2,263,930 | A | 11/1941 | Pasquier |
| 2,266,464 | A | 12/1941 | Kraft |
| 2,740,167 | A | 3/1942 | Scull |
| 2,280,071 | A | 4/1942 | Hamilton |
| 2,282,559 | A | 5/1942 | Byers |
| 2,324,628 | A | 7/1943 | Kahr |
| 2,360,933 | A | 10/1944 | Bunker |
| 2,363,429 | A | 11/1944 | Lowry |
| 2,381,469 | A | 8/1945 | Sweet |
| 2,398,632 | A | 4/1946 | Frost et al. |
| 2,405,602 | A | 8/1946 | Nugent |
| 2,430,200 | A | 11/1947 | Wilson |
| 2,441,364 | A | 5/1948 | Maynard |
| 2,487,571 | A | 11/1949 | Maxwell |
| 2,491,498 | A | 12/1949 | Kahr |
| 2,534,501 | A | 12/1950 | Coleman |
| 2,644,552 | A | 7/1953 | MacDonanld |
| 2,717,420 | A | 9/1955 | Georges |
| 2,729,584 | A | 1/1956 | Foster |
| 2,780,253 | A | 2/1957 | Joa |
| 2,805,852 | A | 9/1957 | Ewert |
| 2,808,624 | A | 10/1957 | Sullivan |
| 2,823,433 | A | 2/1958 | Kendall |
| 2,839,790 | A | 6/1958 | Collings |
| 2,857,302 | A | 10/1958 | Burton et al. |
| 2,863,185 | A | 12/1958 | Reidi |
| 2,865,058 | A | 12/1958 | Andersson et al. |
| 2,875,117 | A | 2/1959 | Potchen et al. |
| 2,878,530 | A | 3/1959 | Hilding |
| 2,894,292 | A | 7/1959 | Gramelspacher |
| 2,914,815 | A | 12/1959 | Alexander |
| 2,926,401 | A | 3/1960 | Place |
| 2,947,040 | A | 8/1960 | Schultz |
| 2,831,223 | A | 9/1960 | DeShazor |
| 2,952,341 | A | 9/1960 | Weiler |
| 2,974,692 | A | 3/1961 | Bolenbach |
| 2,996,751 | A | 8/1961 | Roby |
| 3,039,575 | A | 6/1962 | Graham |
| 3,040,388 | A | 6/1962 | Conn |
| 3,045,294 | A | 7/1962 | Livezey, Jr. |
| 3,090,082 | A | 5/1963 | Bauman |
| 3,100,556 | A | 8/1963 | Ridder |
| 3,125,138 | A | 3/1964 | Bolenbach |
| 3,128,851 | A | 4/1964 | Deridder et al. |

(56) References Cited

U.S. PATENT DOCUMENTS 3,141,392 A 7/1964 Schneider
3,145,503 A 8/1964 Brechin
3,148,482 A 9/1964 Neale
3,162,906 A 12/1964 Dudley
3,172,508 A 3/1965 Doering et al.
3,174,411 A 3/1965 Oestrich et al.
3,175,476 A 3/1965 Franks
3,182,769 A 5/1965 De Ridder
3,192,574 A 7/1965 Jaffe et al.
3,199,258 A 8/1965 Jentoft et al.
3,200,553 A 8/1965 Frashour et al.
3,203,149 A 8/1965 Soddy
3,204,380 A 9/1965 Wilson
3,205,633 A 9/1965 Nusbaum
3,253,377 A 5/1966 Schakel
3,257,225 A 6/1966 Marotta
3,267,630 A 8/1966 Omholt
3,282,010 A 11/1966 King, Jr.
3,286,425 A 11/1966 Brown
3,296,056 A 1/1967 Bechtold
3,301,147 A 1/1967 Clayton et al.
3,310,919 A 3/1967 Bue
3,313,072 A 4/1967 Cue
3,331,171 A 7/1967 Hallock
3,331,176 A 7/1967 Washam
3,332,192 A 7/1967 Kessler et al.
3,339,329 A 9/1967 Berg
3,347,048 A 10/1967 Brown et al.
3,362,127 A 1/1968 McGowan
3,363,381 A 1/1968 Forrest
3,363,382 A 1/1968 Forrest
3,363,383 A 1/1968 La Barge
3,373,071 A 3/1968 Fuerst
3,377,931 A 4/1968 Hilton
3,385,182 A 5/1968 Harvey
3,387,422 A 6/1968 Wanzer
3,397,496 A 8/1968 Sohns
3,444,660 A 5/1969 Feichter
3,449,879 A 6/1969 Bloom
3,460,304 A 8/1969 Braeuninger et al.
3,473,278 A 10/1969 Gossen
3,474,584 A 10/1969 Lynch
3,479,784 A 11/1969 Massagli
3,481,810 A 12/1969 Waite
3,488,828 A 1/1970 Gallagher
3,496,119 A 2/1970 Fitzgerald
3,508,369 A 4/1970 Tennison
3,512,324 A 5/1970 Reed
3,526,420 A 9/1970 Brancaleone
3,535,844 A 10/1970 Glaros
3,538,665 A 11/1970 Gohner
3,538,819 A 11/1970 Gould et al.
3,548,559 A 12/1970 Levine
3,553,919 A 1/1971 Omholt
3,555,761 A 1/1971 Rosebrough
3,555,762 A 1/1971 Costanzo, Jr.
3,570,205 A 3/1971 Payne
3,572,224 A 3/1971 Perry
3,579,941 A 5/1971 Tibbals
3,605,368 A 9/1971 Lalouche
3,619,964 A 11/1971 Passaro et al.
3,627,362 A 12/1971 Brenneman
3,640,191 A 2/1972 Hendrich
3,657,852 A 4/1972 Worthington et al.
3,665,666 A 5/1972 Delcroix
3,667,153 A 6/1972 Christensen
3,671,369 A 6/1972 Kvalheim et al.
3,673,751 A 7/1972 Boassy et al.
3,676,971 A 7/1972 Dombroski
3,679,531 A 7/1972 Wienand et al.
3,687,773 A 8/1972 Wangborg
3,694,983 A 10/1972 Couquet
3,696,575 A 10/1972 Armstrong
3,707,061 A 12/1972 Collette et al.
3,714,747 A 2/1973 Curran
3,720,027 A 3/1973 Christensen
3,731,445 A 5/1973 Hoffmann et al.
3,740,914 A 6/1973 Arnaiz Diez
3,742,672 A 7/1973 Schaeufele
3,745,726 A 7/1973 Thom
3,758,650 A 9/1973 Hurst
3,759,007 A 9/1973 Thiele
3,760,544 A 9/1973 Hawes et al.
3,760,548 A 9/1973 Sauer et al.
3,761,338 A 9/1973 Ungar et al.
3,768,846 A 10/1973 Hensley et al.
3,778,958 A 12/1973 Fowler
3,780,469 A 12/1973 Hancovsky
3,786,608 A 1/1974 Boettcher
3,798,111 A 3/1974 Lane et al.
3,807,113 A 4/1974 Turner
3,808,030 A 4/1974 Bell
3,810,707 A 5/1974 Tungseth et al.
3,849,111 A 11/1974 Kihlstedt
3,849,240 A 11/1974 Mikulak
3,859,000 A 1/1975 Webster
3,883,258 A * 5/1975 Hewson ..... 403/298
3,884,008 A 5/1975 Miller
3,884,328 A 5/1975 Williams
3,902,291 A 9/1975 Zucht
3,902,293 A 9/1975 Witt et al.
3,908,053 A 9/1975 Hettich
3,908,062 A 9/1975 Roberts
3,921,312 A 11/1975 Fuller
3,924,496 A 12/1975 DerMarderosian et al.
3,936,551 A 2/1976 Elmendorf et al.
3,936,758 A 2/1976 Kostelnicek et al.
3,953,661 A 4/1976 Gulley
3,987,599 A 10/1976 Hines
3,988,187 A 10/1976 Witt et al.
4,021,087 A 5/1977 Ferguson
4,037,377 A 7/1977 Howell et al.
4,059,933 A 11/1977 Funk et al.
4,060,437 A 11/1977 Strout
4,065,902 A 1/1978 Lindal
4,067,155 A 1/1978 Ruff et al.
4,074,496 A 2/1978 Fischer
4,090,338 A 5/1978 Bourgade
4,094,090 A 6/1978 Walmer
4,095,913 A 6/1978 Pettersson et al.
4,099,358 A 7/1978 Compaan
4,100,710 A 7/1978 Kowallik
4,143,498 A 3/1979 Martin et al.
4,144,689 A 3/1979 Bains
4,150,517 A 4/1979 Warner
4,156,048 A 5/1979 Davis
4,158,335 A 6/1979 Belcastro
4,164,832 A 8/1979 Van Zandt
4,165,305 A 8/1979 Sundie et al.
4,167,599 A 9/1979 Nissinen
4,169,688 A * 10/1979 Toshio ..... 404/40
4,182,072 A 1/1980 Much
4,186,539 A 2/1980 Harmon et al.
4,196,554 A 4/1980 Anderson et al.
4,198,455 A 4/1980 Spiro et al.
4,226,064 A 10/1980 Kraayenhof
4,242,390 A 12/1980 Nemeth
4,247,390 A 1/1981 Knoll
4,292,774 A 10/1981 Mairle
4,299,070 A 11/1981 Oltmanns et al.
4,304,083 A 12/1981 Anderson
4,316,351 A 2/1982 Ting
4,372,899 A 2/1983 Wiemann et al.
4,376,593 A 3/1983 Schaefer
4,390,580 A 6/1983 Donovan et al.
4,416,097 A 11/1983 Weir
4,426,820 A 1/1984 Terbrack et al.
4,435,935 A 3/1984 Larrea
4,449,346 A 5/1984 Tremblay
4,455,803 A 6/1984 Kornberger
4,461,131 A 7/1984 Pressell
4,471,012 A 9/1984 Maxwell
4,489,115 A 12/1984 Layman et al.
4,501,102 A 2/1985 Knowles

(56) References Cited

U.S. PATENT DOCUMENTS 4,503,115 A 3/1985 Hemels et al.
4,504,347 A 3/1985 Munk et al.
4,505,887 A 3/1985 Miyata et al.
4,512,131 A 4/1985 Laramore
4,517,147 A 5/1985 Taylor et al.
4,520,062 A 5/1985 Ungar et al.
4,538,392 A 9/1985 Hamar et al.
4,561,233 A 12/1985 Harter et al.
4,571,910 A 2/1986 Cosentino
4,594,347 A 6/1986 Ishikawa et al.
4,599,124 A 7/1986 Kelly et al.
4,599,841 A * 7/1986 Haid ..... 52/396.04
4,599,842 A 7/1986 Counihan
4,612,745 A 9/1986 Hovde
4,621,471 A 11/1986 Kuhr et al.
4,640,437 A 2/1987 Weingartner
4,641,469 A 2/1987 Wood
4,643,237 A 2/1987 Rosa
4,646,494 A 3/1987 Saarinen et al.
4,653,138 A 3/1987 Carder
4,653,242 A 3/1987 Ezard
4,672,728 A 6/1987 Nimberger
4,683,631 A 8/1987 Dobbertin
4,703,597 A 11/1987 Eggemar
4,715,162 A 12/1987 Brightwell
4,724,187 A 2/1988 Ungar et al.
4,733,510 A 3/1988 Werner
4,736,563 A 4/1988 Bilhorn
4,738,071 A 4/1988 Ezard
4,741,136 A 5/1988 Thompson
4,747,197 A 5/1988 Charron
4,757,657 A 7/1988 Mitchell
4,757,658 A 7/1988 Kaempen
4,766,443 A 8/1988 Winegard et al.
4,769,963 A 9/1988 Meyerson
4,796,402 A 1/1989 Pajala
4,806,435 A 2/1989 Athey
4,819,532 A 4/1989 Benuzzi et al.
4,819,932 A 4/1989 Trotter, Jr.
4,831,806 A 5/1989 Niese et al.
4,844,972 A 7/1989 Tedeschi et al.
4,845,907 A 7/1989 Meek
4,888,933 A 12/1989 Guomundsson et al.
4,893,449 A 1/1990 Kemper
4,894,272 A 1/1990 Aisley
4,905,442 A 3/1990 Daniels
4,906,484 A 3/1990 Lambuth et al.
4,910,280 A 3/1990 Robbins, III
4,917,532 A 4/1990 Haberhauer et al.
4,920,626 A 5/1990 Nimberger
4,940,503 A 7/1990 Lindgren et al.
4,952,775 A 8/1990 Yokoyama et al.
4,953,335 A 9/1990 Kawaguchi et al.
4,988,131 A 1/1991 Wilson et al.
4,998,395 A 3/1991 Bezner
4,998,396 A 3/1991 Palmersten
5,003,016 A 3/1991 Boeder
5,016,413 A 5/1991 Counihan
5,029,425 A 7/1991 Bogataj
5,034,272 A 7/1991 Lindgren et al.
5,050,362 A 9/1991 Tal et al.
5,052,158 A 10/1991 D'Luzansky
5,058,333 A 10/1991 Schwartz
5,070,662 A 12/1991 Niese
5,074,089 A 12/1991 Kemmer et al.
5,086,599 A 2/1992 Meyerson
5,092,095 A 3/1992 Zadok
5,102,253 A 4/1992 Conti
5,109,898 A 5/1992 Schacht
5,113,632 A 5/1992 Hanson
5,117,603 A 6/1992 Weintraub
5,138,812 A 8/1992 Palmersten
5,148,850 A 9/1992 Urbanick
5,155,952 A 10/1992 Herwegh et al.
5,157,890 A 10/1992 Jines
5,165,816 A 11/1992 Parasin
5,179,811 A 1/1993 Walker et al.
5,179,812 A 1/1993 Hill
5,182,892 A 2/1993 Chase
5,215,802 A 6/1993 Kaars Sijpesteijn
5,216,861 A 6/1993 Meyerson
5,244,303 A 9/1993 Hair
5,247,773 A 9/1993 Weir
5,253,464 A 10/1993 Nilsen
5,259,162 A 11/1993 Nicholas
5,266,384 A 11/1993 O'Dell et al.
5,271,564 A 12/1993 Smith
5,274,979 A 1/1994 Tsai
5,283,102 A 2/1994 Sweet et al.
5,292,155 A 3/1994 Bell et al.
5,295,341 A 3/1994 Kajiwara
5,313,751 A 5/1994 Wittler
5,325,649 A 7/1994 Kajiwara
5,343,665 A 9/1994 Palmersten
5,344,700 A 9/1994 McGath et al.
5,348,778 A 9/1994 Knipp et al.
5,349,796 A 9/1994 Meyerson
5,359,817 A 11/1994 Fulton
5,365,713 A 11/1994 Nicholas et al.
5,390,457 A 2/1995 Sjolander
5,413,840 A 5/1995 Mizuno
5,424,118 A 6/1995 McLaughlin
5,425,302 A 6/1995 Levrai et al.
5,433,048 A 7/1995 Strasser
5,433,806 A 7/1995 Pasquali et al.
5,437,934 A 8/1995 Witt et al.
5,474,831 A 12/1995 Nystrom
5,497,589 A 3/1996 Porter
5,502,939 A 4/1996 Zadok et al.
5,526,857 A 6/1996 Forman
5,527,128 A 6/1996 Rope et al.
5,540,025 A 7/1996 Takehara et al.
D373,203 S 8/1996 Kornfalt
5,555,980 A 9/1996 Johnston et al.
5,566,519 A 10/1996 Almaraz-Miera
5,567,497 A 10/1996 Zegler et al.
5,570,554 A 11/1996 Searer
5,581,967 A 12/1996 Glatz
5,597,024 A 1/1997 Bolyard et al.
5,618,602 A 4/1997 Nelson
5,618,612 A 4/1997 Gstrein
5,623,799 A 4/1997 Kowalski
5,630,304 A 5/1997 Austin
5,647,181 A 7/1997 Hunts
5,657,598 A 8/1997 Wilbs et al.
5,671,575 A 9/1997 Wu
5,685,117 A 11/1997 Nicholson
5,688,569 A 11/1997 Gilmore et al.
5,692,354 A 12/1997 Searer
5,695,875 A 12/1997 Larsson et al.
5,706,621 A 1/1998 Pervan
5,706,623 A 1/1998 Brown
5,719,239 A 2/1998 Mirous et al.
5,735,092 A 4/1998 Clayton et al.
5,736,227 A 4/1998 Sweet et al.
5,755,068 A 5/1998 Ormiston
5,765,808 A 6/1998 Butschbacher et al.
5,768,850 A 6/1998 Chen
5,791,114 A 8/1998 Mandel
5,797,237 A 8/1998 Finkell, Jr.
5,823,240 A 10/1998 Bolyard et al.
5,827,592 A 10/1998 Van Gulik et al.
5,860,267 A 1/1999 Pervan
D406,360 S 3/1999 Finkell, Jr.
5,888,017 A 3/1999 Corrie
5,894,701 A 4/1999 Delorme
5,904,019 A 5/1999 Kooij et al.
5,907,934 A 6/1999 Austin
5,930,947 A 8/1999 Eckhoff
5,931,447 A 8/1999 Butschbacher et al.
5,935,668 A 8/1999 Smith
5,937,612 A 8/1999 Winer et al.
5,941,047 A 8/1999 Johansson
5,943,239 A 8/1999 Shamblin et al.

(56) References Cited

U.S. PATENT DOCUMENTS

| | | | |
|---|---|---|---|
| 5,945,181 | A | 8/1999 | Fisher |
| 5,950,389 | A | 9/1999 | Porter |
| 5,968,625 | A | 10/1999 | Hudson |
| 5,971,655 | A | 10/1999 | Shirakawa |
| 5,987,839 | A | 11/1999 | Hamar et al. |
| 5,987,845 | A | 11/1999 | Laronde |
| 5,996,301 | A | 12/1999 | Conterno |
| 6,006,486 | A | 12/1999 | Moriau et al. |
| 6,012,263 | A | 1/2000 | Church et al. |
| 6,021,615 | A | 2/2000 | Brown |
| 6,021,646 | A | 2/2000 | Burley |
| 6,023,907 | A | 2/2000 | Pervan |
| 6,029,416 | A | 2/2000 | Andersson |
| 6,079,182 | A | 6/2000 | Ellenberger |
| 6,094,882 | A | 8/2000 | Pervan |
| 6,098,365 | A | 8/2000 | Martin et al. |
| 6,101,778 | A | 8/2000 | Martensson |
| 6,106,654 | A | 8/2000 | Velin et al. |
| 6,119,423 | A | 9/2000 | Costantino |
| 6,122,879 | A | 9/2000 | Montes |
| 6,134,854 | A | 10/2000 | Stanchfield |
| 6,141,920 | A | 11/2000 | Kemper |
| 6,143,119 | A | 11/2000 | Seidner |
| 6,148,884 | A | 11/2000 | Bolyard et al. |
| 6,158,915 | A | 12/2000 | Kise |
| 6,164,031 | A | 12/2000 | Counihan |
| 6,182,410 | B1 | 2/2001 | Pervan |
| 6,182,413 | B1 | 2/2001 | Magnusson |
| 6,189,283 | B1 | 2/2001 | Bentley |
| 6,205,639 | B1 | 3/2001 | Pervan |
| 6,209,278 | B1 | 4/2001 | Tychsen |
| 6,216,403 | B1 | 4/2001 | Belbeoc'h |
| 6,216,409 | B1 | 4/2001 | Roy et al. |
| 6,219,982 | B1 | 4/2001 | Eyring |
| 6,230,385 | B1 | 5/2001 | Nelson |
| 6,233,899 | B1 | 5/2001 | Mellert et al. |
| 6,247,285 | B1 | 6/2001 | Moebus |
| 6,253,514 | B1 | 7/2001 | Jobe et al. |
| 6,271,156 | B1 | 8/2001 | Gleason et al. |
| 6,314,701 | B1 | 11/2001 | Meyerson |
| 6,321,499 | B1 | 11/2001 | Chuang |
| 6,324,796 | B1 | 12/2001 | Heath |
| 6,324,803 | B1 | 12/2001 | Pervan |
| 6,324,809 | B1 | 12/2001 | Nelson |
| 6,332,733 | B1 | 12/2001 | Hamberger et al. |
| 6,345,480 | B1 | 2/2002 | Kemper |
| 6,345,481 | B1 | 2/2002 | Nelson |
| 6,346,861 | B2 | 2/2002 | Kim et al. |
| 6,363,677 | B1 | 4/2002 | Chen et al. |
| 6,363,678 | B1 | 4/2002 | Shuler |
| 6,365,258 | B1 | 4/2002 | Alm |
| 6,385,936 | B1 | 5/2002 | Schneider |
| 6,397,547 | B1 | 6/2002 | Martensson |
| 6,404,240 | B1 | 6/2002 | Hakkal et al. |
| 6,418,683 | B1 | 7/2002 | Martensson et al. |
| 6,421,970 | B1 | 7/2002 | Martensson et al. |
| 6,423,257 | B1 | 7/2002 | Stobart |
| 6,437,616 | B1 | 8/2002 | Antone et al. |
| 6,438,919 | B1 | 8/2002 | Knauseder |
| 6,446,405 | B1 | 9/2002 | Pervan |
| 6,446,413 | B1 | 9/2002 | Gruber |
| 6,449,918 | B1 | 9/2002 | Nelson |
| 6,490,836 | B1 | 12/2002 | Moriau et al. |
| 6,497,079 | B1 | 12/2002 | Pletzer et al. |
| 6,505,452 | B1 | 1/2003 | Hannig et al. |
| 6,510,665 | B2 | 1/2003 | Pervan |
| 6,516,579 | B1 | 2/2003 | Pervan |
| 6,517,935 | B1 | 2/2003 | Komfalt et al. |
| 6,521,314 | B2 | 2/2003 | Tychsen |
| 6,526,719 | B2 | 3/2003 | Pletzer et al. |
| 6,532,709 | B2 | 3/2003 | Pervan |
| 6,536,178 | B1 | 3/2003 | Palsson |
| 6,546,691 | B2 | 4/2003 | Leopolder |
| 6,550,205 | B2 | 4/2003 | Neuhofer |
| 6,551,007 | B2 | 4/2003 | Lichtenberg et al. |
| 6,588,165 | B1 | 7/2003 | Wright |
| 6,588,166 | B2 | 7/2003 | Martensson et al. |
| 6,591,568 | B1 | 7/2003 | Palsson |
| 6,601,359 | B2 | 8/2003 | Olofsson |
| 6,606,834 | B2 | 8/2003 | Martensson et al. |
| 6,617,009 | B1 * | 9/2003 | Chen et al. ..... 428/195.1 |
| 6,647,689 | B2 | 11/2003 | Pletzer et al. |
| 6,647,690 | B1 * | 11/2003 | Martensson ..... 52/601 |
| 6,670,019 | B2 | 12/2003 | Andersson |
| 6,672,030 | B2 | 1/2004 | Schulte |
| 6,681,820 | B2 | 1/2004 | Olofsson |
| 6,682,254 | B1 | 1/2004 | Olofsson |
| 6,685,391 | B1 | 2/2004 | Gideon |
| 6,711,869 | B2 | 3/2004 | Tychsem |
| 6,729,091 | B1 | 5/2004 | Martensson |
| 6,745,534 | B2 | 6/2004 | Kornfalt |
| 6,763,643 | B1 | 7/2004 | Martensson |
| 6,769,217 | B2 * | 8/2004 | Nelson ..... 52/582.1 |
| 6,769,219 | B2 | 8/2004 | Schwitte et al. |
| 6,769,835 | B2 | 8/2004 | Stridsman |
| 6,786,016 | B1 | 9/2004 | Wood |
| 6,802,166 | B1 | 10/2004 | Gerhard |
| 6,804,926 | B1 | 10/2004 | Eisermann |
| 6,805,951 | B2 | 10/2004 | Kornfalt et al. |
| 6,851,237 | B2 | 2/2005 | Niese et al. |
| 6,851,241 | B2 | 2/2005 | Pervan |
| 6,854,235 | B2 | 2/2005 | Martensson |
| 6,860,074 | B2 | 3/2005 | Stanchfield |
| 6,862,857 | B2 | 3/2005 | Tychsen |
| 6,865,855 | B2 | 3/2005 | Knauseder |
| 6,880,305 | B2 | 4/2005 | Pervan et al. |
| 6,880,307 | B2 | 4/2005 | Schwitte et al. |
| 6,898,913 | B2 | 5/2005 | Pervan |
| 6,918,220 | B2 | 7/2005 | Pervan |
| 6,920,732 | B2 | 7/2005 | Martensson |
| 6,922,964 | B2 | 8/2005 | Pervan |
| 6,931,798 | B1 | 8/2005 | Pocai |
| 6,966,161 | B2 | 11/2005 | Palsson et al. |
| RE38,950 | E | 1/2006 | Maiers et al. |
| 7,003,924 | B2 | 2/2006 | Kettler et al. |
| 7,015,727 | B2 | 3/2006 | Balasubramanian |
| 7,021,019 | B2 | 4/2006 | Knauseder |
| 7,051,486 | B2 | 5/2006 | Pervan |
| 7,086,205 | B2 | 8/2006 | Pervan |
| 7,121,058 | B2 | 10/2006 | Palsson et al. |
| 7,121,059 | B2 | 10/2006 | Pervan |
| 7,131,242 | B2 | 11/2006 | Martensson |
| 7,146,772 | B2 | 12/2006 | Ralf |
| 7,152,507 | B2 | 12/2006 | Solari |
| 7,188,456 | B2 | 3/2007 | Knauseder |
| 7,210,272 | B2 | 5/2007 | Friday |
| 7,251,916 | B2 | 8/2007 | Konzelmann et al. |
| 7,332,053 | B2 | 2/2008 | Palsson et al. |
| 7,337,588 | B1 | 3/2008 | Moebus |
| 7,347,328 | B2 | 3/2008 | Hartwall |
| 7,377,081 | B2 | 5/2008 | Ruhdorfer |
| 7,398,628 | B2 | 7/2008 | Van Horne |
| 7,441,385 | B2 | 10/2008 | Palsson et al. |
| 7,444,791 | B1 | 11/2008 | Pervan |
| 7,451,578 | B2 | 11/2008 | Hannig |
| 7,484,337 | B2 | 2/2009 | Hecht |
| 7,497,058 | B2 | 3/2009 | Martensson |
| 7,552,568 | B2 | 6/2009 | Palsson et al. |
| 7,603,826 | B1 | 10/2009 | Moebus |
| 7,614,197 | B2 | 11/2009 | Nelson |
| 7,617,651 | B2 | 11/2009 | Grafenauer |
| 7,634,884 | B2 | 12/2009 | Pervan et al. |
| 7,665,267 | B2 | 2/2010 | Moriau et al. |
| 7,726,088 | B2 | 6/2010 | Muehlebach |
| 7,820,287 | B2 | 10/2010 | Kornfalt et al. |
| 7,841,144 | B2 | 11/2010 | Pervan |
| 7,856,784 | B2 | 12/2010 | Martensson |
| 7,856,785 | B2 | 12/2010 | Pervan |
| 7,856,789 | B2 | 12/2010 | Eisermann |
| 7,877,956 | B2 | 2/2011 | Martensson |
| 7,896,571 | B1 | 3/2011 | Hannig et al. |
| 7,980,039 | B2 | 7/2011 | Groeke et al. |
| 7,980,043 | B2 | 7/2011 | Moebus |
| 8,006,458 | B1 | 8/2011 | Olofsson et al. |

(56) References Cited

U.S. PATENT DOCUMENTS

| | | | |
|---|---|---|---|
| 8,028,486 | B2 | 10/2011 | Pervan et al. |
| 8,037,657 | B2 | 10/2011 | Sjoberg et al. |
| 8,038,363 | B2 | 10/2011 | Hannig et al. |
| 8,117,795 | B2 | 2/2012 | Knauseder |
| 8,146,318 | B2 | 4/2012 | Palsson |
| 8,234,834 | B2 | 8/2012 | Martensson et al. |
| 8,276,342 | B2 | 10/2012 | Martensson |
| 8,402,709 | B2 | 3/2013 | Martensson |
| 8,429,869 | B2 | 4/2013 | Pervan |
| 8,516,767 | B2 | 8/2013 | Engstrom |
| 8,544,233 | B2 | 10/2013 | Palsson |
| 8,578,675 | B2 | 11/2013 | Palsson |
| 8,615,952 | B2 | 12/2013 | Engstrom |
| 8,631,623 | B2 | 1/2014 | Engstrom |
| 8,661,762 | B2 | 3/2014 | Martensson et al. |
| 8,720,148 | B2 | 5/2014 | Engstrom |
| 8,789,334 | B2 | 7/2014 | Moriau et al. |
| 8,875,465 | B2 | 11/2014 | Mårtensson |
| 8,978,334 | B2 | 3/2015 | Engstrom |
| 9,032,685 | B2 | 5/2015 | Martensson et al. |
| 9,115,500 | B2 | 8/2015 | Engstrom |
| 9,140,009 | B2 | 9/2015 | Engstrom |
| 9,255,414 | B2 | 2/2016 | Palsson et al. |
| 9,260,869 | B2 | 2/2016 | Palsson et al. |
| 9,316,006 | B2 | 4/2016 | Palsson et al. |
| 9,322,162 | B2 | 4/2016 | Olofsson et al. |
| 2001/0024707 | A1 | 9/2001 | Andersson et al. |
| 2001/0029720 | A1 | 10/2001 | Pervan |
| 2002/0007608 | A1 | 1/2002 | Pervan |
| 2002/0046526 | A1 | 4/2002 | Knauseder |
| 2002/0046528 | A1 | 4/2002 | Pervan et al. |
| 2002/0095895 | A1 | 7/2002 | Daly et al. |
| 2002/0112429 | A1 | 8/2002 | Niese et al. |
| 2002/0112433 | A1 | 8/2002 | Pervan |
| 2002/0127374 | A1 | 9/2002 | Spratling |
| 2002/0148551 | A1 | 10/2002 | Knauseder |
| 2002/0178674 | A1 | 12/2002 | Pervan |
| 2002/0178681 | A1 | 12/2002 | Zancai et al. |
| 2002/0178682 | A1 | 12/2002 | Pervan |
| 2002/0189183 | A1 | 12/2002 | Ricciardelli |
| 2002/0189747 | A1 | 12/2002 | Steinwender |
| 2003/0009971 | A1 | 1/2003 | Palmberg |
| 2003/0009972 | A1 | 1/2003 | Pervan et al. |
| 2003/0024200 | A1 | 2/2003 | Moriau et al. |
| 2003/0084634 | A1 | 5/2003 | Stanchfield |
| 2003/0094230 | A1 | 5/2003 | Sjoberg |
| 2003/0112913 | A1 | 6/2003 | Balasubramanian |
| 2003/0118812 | A1 | 6/2003 | Kornfalt |
| 2003/0141004 | A1 | 7/2003 | Palmblad |
| 2003/0145540 | A1 | 8/2003 | Brunedal |
| 2003/0154678 | A1 | 8/2003 | Stanchfield |
| 2003/0159389 | A1 | 8/2003 | Kornfalt |
| 2003/0224147 | A1 | 12/2003 | Maine et al. |
| 2004/0016197 | A1 | 1/2004 | Ruhdorfer |
| 2004/0031225 | A1 | 2/2004 | Fowler |
| 2004/0031226 | A1 | 2/2004 | Miller |
| 2004/0031227 | A1 | 2/2004 | Knauseder |
| 2004/0035077 | A1 | 2/2004 | Martensson et al. |
| 2004/0040235 | A1 | 3/2004 | Kurtz |
| 2004/0041225 | A1 | 3/2004 | Nemoto |
| 2004/0139678 | A1 | 7/2004 | Pervan |
| 2004/0182036 | A1 | 9/2004 | Sjoberg et al. |
| 2004/0191461 | A1 | 9/2004 | Riccobene |
| 2004/0211143 | A1 | 10/2004 | Hanning |
| 2004/0211144 | A1 | 10/2004 | Stanchfield |
| 2004/0250492 | A1 | 12/2004 | Becker |
| 2005/0034405 | A1 | 2/2005 | Pervan |
| 2005/0144881 | A1 | 7/2005 | Tate |
| 2005/0166526 | A1 | 8/2005 | Stanchfield |
| 2005/0210810 | A1 | 9/2005 | Pervan |
| 2005/0252130 | A1 | 11/2005 | Martensson |
| 2006/0101769 | A1 | 5/2006 | Pervan |
| 2006/0236642 | A1 | 10/2006 | Pervan |
| 2006/0248836 | A1 | 11/2006 | Martensson |
| 2007/0006543 | A1 | 1/2007 | Engstrom |
| 2007/0028547 | A1 | 2/2007 | Grafenauer et al. |
| 2007/0240376 | A1 | 10/2007 | Engstrom |
| 2008/0000186 | A1 | 1/2008 | Pervan |
| 2008/0134613 | A1 | 6/2008 | Pervan |
| 2008/0216434 | A1 | 9/2008 | Pervan |
| 2008/0236088 | A1 | 10/2008 | Hannig |
| 2008/0271403 | A1 | 11/2008 | Palsson |
| 2009/0019806 | A1 | 1/2009 | Muehlebach |
| 2009/0019808 | A1 | 1/2009 | Palsson et al. |
| 2009/0064624 | A1 | 3/2009 | Sokol |
| 2009/0100782 | A1 | 4/2009 | Groeke et al. |
| 2009/0193748 | A1 | 8/2009 | Boo et al. |
| 2009/0199500 | A1 | 8/2009 | LeBlang |
| 2009/0217615 | A1 | 9/2009 | Engstrom |
| 2009/0249733 | A1 | 10/2009 | Moebus |
| 2010/0031599 | A1 | 2/2010 | Kennedy et al. |
| 2010/0043333 | A1 | 2/2010 | Hannig |
| 2010/0058700 | A1 | 3/2010 | LeBlang |
| 2010/0236707 | A1 | 9/2010 | Studer et al. |
| 2011/0078977 | A1 | 4/2011 | Martensson et al. |
| 2011/0167751 | A1 | 7/2011 | Engstrom |
| 2011/0173914 | A1 | 7/2011 | Engstrom |
| 2011/0225922 | A1 | 9/2011 | Pervan et al. |
| 2011/0271631 | A1 | 11/2011 | Engstrom |
| 2011/0271632 | A1 | 11/2011 | Cappelle et al. |
| 2011/0293361 | A1 | 12/2011 | Olofsson |
| 2012/0042595 | A1 | 2/2012 | De Boe |
| 2012/0055112 | A1 | 3/2012 | Engstrom |
| 2012/0216472 | A1 | 8/2012 | Martensson et al. |
| 2012/0233948 | A1 | 9/2012 | Palsson |
| 2012/0247053 | A1 | 10/2012 | Martensson |
| 2012/0291396 | A1 | 11/2012 | Martensson |
| 2012/0304590 | A1 | 12/2012 | Engstrom |
| 2013/0042555 | A1 | 2/2013 | Martensson |
| 2013/0067840 | A1 | 3/2013 | Martensson |
| 2013/0241103 | A1 | 9/2013 | Engstrom |
| 2013/0291467 | A1 | 11/2013 | Palsson et al. |
| 2014/0033630 | A1 | 2/2014 | Engstrom |
| 2014/0137506 | A1 | 5/2014 | Palsson |
| 2014/0157711 | A1 | 6/2014 | Palsson et al. |
| 2014/0157721 | A1 | 6/2014 | Engstrom |
| 2014/0165493 | A1 | 6/2014 | Palsson et al. |
| 2014/0283476 | A1 | 9/2014 | Engstrom |
| 2015/0075105 | A1 | 3/2015 | Engstrom |
| 2015/0184397 | A1 | 7/2015 | Engstrom |
| 2016/0040438 | A1 | 2/2016 | Engstrom |
| 2016/0069087 | A1 | 3/2016 | Engstrom |

FOREIGN PATENT DOCUMENTS

| | | | |
|---|---|---|---|
| AU | 1 309 883 | A | 10/1983 |
| AU | 199 732 569 | B2 | 6/1997 |
| AU | 200 020 703 | C | 6/2000 |
| BE | 417 526 | A | 10/1936 |
| BE | 556 860 | A | 5/1957 |
| BE | 557 844 | A | 3/1960 |
| BE | 765 817 | A2 | 9/1971 |
| BE | 1 010 339 | A3 | 6/1998 |
| BE | 1 010 487 | A6 | 10/1998 |
| CA | 991 373 | A1 | 6/1976 |
| CA | 1 049 736 | A1 | 3/1979 |
| CA | 1 169 106 | A1 | 6/1984 |
| CA | 1 325 873 | C | 1/1994 |
| CA | 2 226 286 | A1 | 12/1997 |
| CA | 2 252 791 | C | 5/1999 |
| CA | 2 162 836 | C | 6/1999 |
| CA | 2 289 309 | A1 | 11/1999 |
| CA | 2 150 384 | C | 4/2005 |
| CH | 200 949 | A | 11/1938 |
| CH | 211 677 | A | 10/1940 |
| CH | 211 877 | A | 10/1940 |
| CH | 562 377 | A5 | 5/1975 |
| CH | 640 455 | A5 | 1/1984 |
| CN | 1 054 215 | A | 9/1991 |
| CN | 2 091 909 | U | 1/1992 |
| CN | 1 115 351 | A | 1/1996 |
| CN | 1 124 941 | A | 6/1996 |
| CN | 2 242 278 | Y | 12/1996 |
| DE | 2 09 979 | C | 11/1906 |

(56) References Cited

FOREIGN PATENT DOCUMENTS

| | | | |
|---|---|---|---|
| DE | 5 17 353 | | 2/1931 |
| DE | 12 12 275 | B | 3/1966 |
| DE | 19 34 295 | U | 3/1966 |
| DE | 19 85 418 | U | 5/1968 |
| DE | 15 34 802 | A1 | 4/1970 |
| DE | 71 02 476 | | 6/1971 |
| DE | 16 58 875 | B1 | 9/1971 |
| DE | 20 07 129 | A1 | 9/1971 |
| DE | 15 34 278 | A1 | 11/1971 |
| DE | 21 39 283 | A1 | 2/1972 |
| DE | 21 01 782 | A1 | 7/1972 |
| DE | 21 02 537 | A1 | 8/1972 |
| DE | 21 45 024 | A1 | 3/1973 |
| DE | 21 59 042 | A1 | 6/1973 |
| DE | 22 05 232 | A1 | 8/1973 |
| DE | 22 38 660 | A1 | 2/1974 |
| DE | 22 51 762 | | 5/1974 |
| DE | 22 52 643 | A1 | 5/1974 |
| DE | 74 02 354 | | 5/1974 |
| DE | 25 02 992 | A1 | 7/1976 |
| DE | 25 52 622 | A1 | 5/1977 |
| DE | 26 16 077 | A1 | 10/1977 |
| DE | 28 02 151 | A1 | 7/1979 |
| DE | 29 17 025 | A1 | 11/1980 |
| DE | 29 16 482 | A1 | 12/1980 |
| DE | 29 27 425 | A1 | 1/1981 |
| DE | 31 04 519 | | 2/1981 |
| DE | 29 40 945 | A1 | 4/1981 |
| DE | 30 41 781 | A1 | 6/1982 |
| DE | 30 46 618 | A1 | 7/1982 |
| DE | 31 17 605 | A1 | 11/1982 |
| DE | 32 14 207 | | 11/1982 |
| DE | 32 46 376 | | 6/1984 |
| DE | 33 04 992 | | 8/1984 |
| DE | 33 06 609 | | 9/1984 |
| DE | 33 19 235 | | 11/1984 |
| DE | 33 43 601 | | 6/1985 |
| DE | 34 12 882 | A1 | 10/1985 |
| DE | 86 00 241 | U1 | 4/1986 |
| DE | 86 04 004 | | 4/1986 |
| DE | 35 12 204 | | 10/1986 |
| DE | 35 44 845 | | 6/1987 |
| DE | 36 31 390 | | 12/1987 |
| DE | 36 40 822 | | 6/1988 |
| DE | 37 41 041 | A1 | 9/1988 |
| DE | 39 33 611 | A1 | 4/1991 |
| DE | 41 05 207 | A1 | 8/1991 |
| DE | 40025470 | | 8/1991 |
| DE | 39 32 980 | | 11/1991 |
| DE | 41 30 115 | A1 | 3/1993 |
| DE | 93 00 306 | | 3/1993 |
| DE | 41 34 452 | | 4/1993 |
| DE | 42 15 273 | | 11/1993 |
| DE | 42 42 530 | | 6/1994 |
| DE | 43 44 089 | | 7/1994 |
| DE | 43 13 037 | C1 | 8/1994 |
| DE | 93 17 191 | | 3/1995 |
| DE | 44 02 352 | A1 | 8/1995 |
| DE | 195 03 948 | A1 | 8/1996 |
| DE | 295 20 966 | U1 | 8/1996 |
| DE | 29614 086 | | 10/1996 |
| DE | 196 01 322 | A1 | 5/1997 |
| DE | 297 03 962 | | 6/1997 |
| DE | 29710175 | | 8/1997 |
| DE | 29711960 | | 10/1997 |
| DE | 196 51 149 | | 6/1998 |
| DE | 197 04 292 | A1 | 8/1998 |
| DE | 197 09 641 | | 9/1998 |
| DE | 197 18 319 | A1 | 11/1998 |
| DE | 198 21 938 | A1 | 11/1999 |
| DE | 198 51 200 | C1 | 3/2000 |
| DE | 200 01 225 | | 7/2000 |
| DE | 199 40 837 | A1 | 11/2000 |
| DE | 199 25 248 | | 12/2000 |
| DE | 200 18 284 | | 1/2001 |
| DE | 199 33 343 | A1 | 2/2001 |
| DE | 200 17 461 | | 2/2001 |
| DE | 200 27 461 | | 3/2001 |
| DE | 199 63 203 | A1 | 9/2001 |
| DE | 100 01 076 | | 10/2001 |
| DE | 202 03 311 | U1 | 5/2002 |
| DE | 100 62 873 | | 7/2002 |
| DE | 202 06 751 | U1 | 8/2002 |
| DE | 101 20 062 | A1 | 11/2002 |
| DE | 101 31 248 | | 1/2003 |
| DE | 102 42 647 | A1 | 6/2004 |
| DE | 10 2004 055 951 | A1 | 7/2005 |
| DE | 10 2005 002 297.9 | | 8/2005 |
| DE | 10 2007 035 648 | | 1/2009 |
| DE | 20 2009 004 530 | | 6/2009 |
| DE | 10 2010 020 089.1 | | 5/2010 |
| DE | 10 2009 022 483 | A1 | 12/2010 |
| DE | 10 2009 038 750 | | 3/2011 |
| DE | 10 201 004717.1 | | 7/2011 |
| DE | 20 2004 021 867 | | 12/2011 |
| EP | 0 024 360 | A1 | 3/1981 |
| EP | 0 044 371 | A1 | 1/1982 |
| EP | 0 085 196 | | 8/1983 |
| EP | 0 117 707 | A2 | 9/1984 |
| EP | 0 161 233 | A1 | 11/1985 |
| EP | 0 196 672 | A2 | 10/1986 |
| EP | 0 220 389 | A2 | 5/1987 |
| EP | 0 248 127 | | 12/1987 |
| EP | 0 256 189 | A1 | 2/1988 |
| EP | 0 279 278 | A2 | 8/1988 |
| EP | 0 335 778 | A2 | 10/1989 |
| EP | 0 401 146 | A1 | 12/1990 |
| EP | 0 487 925 | A1 | 6/1992 |
| EP | 0 508 083 | A1 | 10/1992 |
| EP | 0 508 260 | A2 | 10/1992 |
| EP | 0 562 402 | A1 | 9/1993 |
| EP | 0 604 896 | A1 | 7/1994 |
| EP | 0 623 724 | | 11/1994 |
| EP | 0 652 332 | A1 | 5/1995 |
| EP | 0 652 340 | | 5/1995 |
| EP | 0 690 185 | A1 | 1/1996 |
| EP | 0 698 162 | | 2/1996 |
| EP | 0 711 886 | | 5/1996 |
| EP | 0 715 037 | A1 | 6/1996 |
| EP | 0 799 679 | A2 | 10/1997 |
| EP | 0 813 641 | A1 | 12/1997 |
| EP | 0 843 763 | | 5/1998 |
| EP | 0 849 416 | | 6/1998 |
| EP | 0 85 5482 | | 7/1998 |
| EP | 0 877 130 | | 11/1998 |
| EP | 0 903 451 | | 3/1999 |
| EP | 0 906 994 | A1 | 4/1999 |
| EP | 0 958 441 | | 11/1999 |
| EP | 0 969 163 | | 1/2000 |
| EP | 0 969 164 | | 1/2000 |
| EP | 0 974 713 | | 1/2000 |
| EP | 1 045 083 | A1 | 10/2000 |
| EP | 1 120 515 | A1 | 8/2001 |
| EP | 1 146 182 | A2 | 10/2001 |
| EP | 1 229 181 | | 8/2002 |
| EP | 1 262 608 | A2 | 12/2002 |
| EP | 1 279 778 | A2 | 1/2003 |
| EP | 1 308 577 | A2 | 5/2003 |
| EP | 1 350 904 | A2 | 10/2003 |
| EP | 1 359 266 | A2 | 11/2003 |
| EP | 1 367 194 | A2 | 12/2003 |
| EP | 1 420 125 | A2 | 5/2004 |
| EP | 1 437 457 | A2 | 7/2004 |
| EP | 2 400 076 | | 8/2004 |
| EP | 2 034 106 | | 3/2009 |
| FI | 843060 | A | 8/1984 |
| FR | 557844 | A | 8/1923 |
| FR | 1175582 | A | 3/1959 |
| FR | 1215852 | A | 4/1960 |
| FR | 1293043 | | 5/1962 |
| FR | 1372596 | A | 9/1964 |
| FR | 1511292 | A | 1/1968 |
| FR | 2209024 | A1 | 6/1974 |
| FR | 2268922 | A1 | 11/1975 |

(56) References Cited

FOREIGN PATENT DOCUMENTS

| | | | |
|---|---|---|---|
| FR | 2278876 | A1 | 2/1976 |
| FR | 2345560 | A1 | 10/1977 |
| FR | 2362254 | A1 | 3/1978 |
| FR | 2416988 | A1 | 9/1979 |
| FR | 2445874 | A1 | 8/1980 |
| FR | 2568295 | | 1/1986 |
| FR | 2630149 | | 10/1989 |
| FR | 2637932 | | 4/1990 |
| FR | 2675174 | | 10/1992 |
| FR | 2691491 | | 11/1993 |
| FR | 2691691 | | 12/1993 |
| FR | 2697275 | | 4/1994 |
| FR | 2712329 | | 5/1995 |
| FR | 2781513 | | 1/2000 |
| FR | 2785633 | | 5/2000 |
| FR | 2810060 | | 12/2001 |
| FR | 2891491 | A1 | 4/2007 |
| GB | 240629 | A | 10/1925 |
| GB | 356270 | A | 9/1931 |
| GB | 424057 | | 2/1935 |
| GB | 448329 | A | 6/1936 |
| GB | 471438 | A | 9/1937 |
| GB | 585205 | | 1/1947 |
| GB | 589635 | A | 6/1947 |
| GB | 599793 | | 3/1948 |
| GB | 636423 | | 4/1950 |
| GB | 647812 | A | 12/1950 |
| GB | 812671 | | 4/1959 |
| GB | 875327 | A | 8/1961 |
| GB | 1027709 | A | 4/1966 |
| GB | 1039949 | A | 8/1966 |
| GB | 1127915 | A | 9/1968 |
| GB | 1161838 | A | 8/1969 |
| GB | 1171337 | A | 11/1969 |
| GB | 1183401 | A | 3/1970 |
| GB | 1191656 | A | 5/1970 |
| GB | 1212983 | | 11/1970 |
| GB | 1237744 | | 6/1971 |
| GB | 1275511 | A | 5/1972 |
| GB | 1308011 | A | 2/1973 |
| GB | 1348272 | | 3/1974 |
| GB | 1430423 | | 3/1976 |
| GB | 1445687 | A | 8/1976 |
| GB | 1485419 | A | 9/1977 |
| GB | 2117813 | | 10/1983 |
| GB | 2124672 | A | 2/1984 |
| GB | 2126106 | | 3/1984 |
| GB | 2142670 | | 1/1985 |
| GB | 2168732 | | 6/1986 |
| GB | 2167465 | | 1/1989 |
| GB | 2221740 | A | 2/1990 |
| GB | 222753 | | 9/1990 |
| GB | 2240039 | A | 7/1991 |
| GB | 2243381 | | 10/1991 |
| GB | 2256023 | | 11/1992 |
| GB | 2325342 | A | 11/1998 |
| GB | 2365880 | A | 2/2002 |
| IT | 444123 | | 1/1949 |
| IT | 812671 | | 4/1959 |
| JP | 5465528 | | 5/1979 |
| JP | 57119056 | | 7/1982 |
| JP | 59041560 | A | 3/1984 |
| JP | 59186336 | | 12/1984 |
| JP | S6414838 | A | 1/1989 |
| JP | S6414839 | U | 1/1989 |
| JP | 1178659 | | 7/1989 |
| JP | H 01178659 | A | 7/1989 |
| JP | H 02285145 | A | 11/1990 |
| JP | H 03318343 | U | 2/1991 |
| JP | 3046645 | | 4/1991 |
| JP | H 0344645 | | 4/1991 |
| JP | 3110258 | | 5/1991 |
| JP | H 03110258 | A | 5/1991 |
| JP | 3169967 | | 7/1991 |
| JP | 3202550 | | 9/1991 |
| JP | 4106264 | | 4/1992 |
| JP | 4191001 | | 7/1992 |
| JP | H 04191001 | A | 7/1992 |
| JP | 04261955 | A | 9/1992 |
| JP | H 0518028 | A | 1/1993 |
| JP | 5148984 | | 6/1993 |
| JP | 6146553 | | 5/1994 |
| JP | 6200611 | A | 7/1994 |
| JP | H 0656310 | U | 8/1994 |
| JP | 6315944 | A | 11/1994 |
| JP | 6320510 | | 11/1994 |
| JP | 407052103 | | 2/1995 |
| JP | H 0 752103 | A | 2/1995 |
| JP | 70769823 | | 3/1995 |
| JP | 7180333 | | 7/1995 |
| JP | 7189466 | A | 7/1995 |
| JP | 7229276 | | 8/1995 |
| JP | H 07229276 | A | 8/1995 |
| JP | 7279366 | | 10/1995 |
| JP | H 07279366 | A | 10/1995 |
| JP | 7300979 | | 11/1995 |
| JP | 7310426 | | 11/1995 |
| JP | 961207 | | 2/1996 |
| JP | H 0874405 | A | 3/1996 |
| JP | 8086078 | | 4/1996 |
| JP | 8109734 | A | 4/1996 |
| JP | H 0886078 | A | 4/1996 |
| JP | 8270193 | A | 10/1996 |
| JP | H 08268344 | A | 10/1996 |
| JP | H 0938906 | A | 2/1997 |
| JP | H 0988315 | A | 3/1997 |
| JP | H 09256603 | A | 9/1997 |
| JP | 10219975 | A | 8/1998 |
| JP | 5154806 | B2 | 8/2008 |
| JP | 4203141 | B2 | 12/2008 |
| JP | 5304714 | B2 | 10/2013 |
| KR | 9533446 | A | 12/1995 |
| NL | 7601773 | | 2/1975 |
| NO | 157871 | | 7/1984 |
| NO | 305614 | | 5/1995 |
| PL | 26931 | U1 | 6/1989 |
| SE | 372 051 | | 12/1974 |
| SE | 7114900-9 | | 12/1974 |
| SE | 7706470 | | 12/1978 |
| SE | 450 141 | | 6/1987 |
| SE | 8206934-5 | | 6/1987 |
| SE | 457 737 | | 7/1989 |
| SE | 462 809 | | 4/1990 |
| SE | 467 150 | | 6/1992 |
| SE | 501 014 | | 10/1994 |
| SE | 9301595-6 | | 10/1994 |
| SE | 9500810 | | 3/1995 |
| SE | 502 994 | | 3/1996 |
| SE | 503 861 | | 9/1996 |
| SE | 509 059 | | 11/1998 |
| SE | 509 060 | | 11/1998 |
| SE | 512 290 | | 2/2000 |
| SE | 512 313 | | 2/2000 |
| SE | 513 189 | C2 | 7/2000 |
| SE | 514 645 | C2 | 3/2001 |
| SE | 0001149 | | 10/2001 |
| SU | 363795 | A1 | 1/1973 |
| SU | 857393 | A1 | 8/1981 |
| WO | WO 80/02155 | | 10/1980 |
| WO | WO 82/00313 | A1 | 2/1982 |
| WO | WO 84/02155 | A1 | 6/1984 |
| WO | WO 87/03839 | | 7/1987 |
| WO | WO 90/00656 | A1 | 1/1990 |
| WO | WO 92/12074 | A2 | 7/1992 |
| WO | WO 92/17657 | | 10/1992 |
| WO | WO 93/13280 | | 7/1993 |
| WO | WO 93/19910 | A1 | 10/1993 |
| WO | WO 94/01628 | | 1/1994 |
| WO | WO 94/04773 | A1 | 3/1994 |
| WO | WO 94/22678 | A1 | 10/1994 |
| WO | WO 94/26999 | A1 | 11/1994 |
| WO | WO 95/05274 | A1 | 3/1995 |
| WO | WO 95/06176 | A1 | 3/1995 |
| WO | WO 95/14834 | A1 | 6/1995 |

(56) References Cited

FOREIGN PATENT DOCUMENTS

| | | | |
|---|---|---|---|
| WO | WO 96/12857 | | 5/1996 |
| WO | WO 96/23942 | | 8/1996 |
| WO | WO 96/27719 | | 9/1996 |
| WO | WO 96/27721 | | 9/1996 |
| WO | WO 96/30177 | | 10/1996 |
| WO | WO 97/47834 | A1 | 12/1997 |
| WO | WO 98/22677 | A1 | 5/1998 |
| WO | WO 98/22678 | | 5/1998 |
| WO | WO 98/24994 | | 6/1998 |
| WO | WO 98/24995 | | 6/1998 |
| WO | WO 98/58142 | | 12/1998 |
| WO | WO 99/01628 | | 1/1999 |
| WO | WO 99/13179 | A1 | 3/1999 |
| WO | WO 99/40273 | | 8/1999 |
| WO | WO 99/66151 | | 12/1999 |
| WO | WO 99/66152 | | 12/1999 |
| WO | WO 00/06854 | | 2/2000 |
| WO | WO 00/20705 | A1 | 4/2000 |
| WO | WO 00/20706 | A1 | 4/2000 |
| WO | WO 00/47841 | A1 | 8/2000 |
| WO | WO 00/56802 | | 9/2000 |
| WO | WO 00/63510 | | 10/2000 |
| WO | WO 00/66856 | | 11/2000 |
| WO | WO 01/02669 | | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 00/02214 | | 3/2001 |
| WO | WO 01/20101 | | 3/2001 |
| WO | WO 01/31141 | | 5/2001 |
| WO | WO 01/48332 | A1 | 7/2001 |
| WO | WO 01/51732 | A1 | 7/2001 |
| WO | WO 01/51733 | | 7/2001 |
| WO | WO 01/53628 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/88306 | A1 | 11/2001 |
| WO | WO 01/88307 | A1 | 11/2001 |
| WO | WO 01/96688 | A1 | 12/2001 |
| WO | WO 01/98604 | A1 | 12/2001 |
| WO | WO 02/055809 | A1 | 7/2002 |
| WO | WO 02/055810 | A1 | 7/2002 |
| WO | WO 2007/089186 | A1 | 8/2002 |
| WO | WO 02/081843 | | 10/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/078761 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 03/093686 | | 11/2003 |
| WO | WO 2004/016877 | A1 | 2/2004 |
| WO | WO 2004/020764 | A1 | 3/2004 |
| WO | WO 2004/081316 | A1 | 9/2004 |
| WO | WO 2004/085765 | A1 | 10/2004 |
| WO | WO 2005/040521 | A2 | 5/2005 |
| WO | WO 2005/054599 | A1 | 6/2005 |
| WO | WO 2005/059269 | | 6/2005 |
| WO | WO 2006/043893 | A1 | 4/2006 |
| WO | WO 2006/104436 | A1 | 10/2006 |
| WO | WO 2007/008139 | | 1/2007 |
| WO | WO 2007/141605 | A2 | 12/2007 |
| WO | WO 2008/004960 | | 1/2008 |
| WO | WO 2008/068245 | | 6/2008 |
| WO | WO 2009/066153 | | 5/2009 |
| WO | WO 2009/116926 | A1 | 9/2009 |
| WO | WO 2009/139687 | A1 | 11/2009 |
| WO | WO 2010/082171 | A2 | 7/2010 |
| WO | WO 2010/108980 | A1 | 9/2010 |
| WO | WO 2010/136171 | A1 | 12/2010 |
| WO | WO 2011/085788 | A1 | 7/2011 |
| WO | WO 2011/085825 | A1 | 7/2011 |
| WO | WO 2011/087425 | A1 | 7/2011 |
| WO | WO 2011/096879 | A1 | 8/2011 |
| WO | WO 2011/141043 | A1 | 11/2011 |

OTHER PUBLICATIONS

Traditional Details; For Building Restoration, Renovation, and Rehabilitation: From the 1932-1951 Editions of Architectvral Graphic Standards; John Wiley & Sons, Inc.

Traindustrins Handbook "Snickeriarbete", Knut Larsson, Tekno's Handbocker Publikation 12-11 (1952).

Elements of Rolling Practice; The United Steel Companies Limited Sheffield, England, 1963; pp. 116-117.

Die mobile; Terbrack; 1968.

High-Production Roll Forming; Society of Manufacturing Engineers Marketing Services Depmiment; pp. 189-192; George T. Halmos; 1983.

Fundamentals of Building Construction Materials and Methods; Copyright 1985; pp. 11. cited by other. Automated Program of Designing Snap-fits; Aug. 1987; pp. 3.

Automated Program of Designing Snap-fits; Aug. 1987; pp. 3.

Plastic Part Technology; 1991; pp. 161-162.

Technoscope; Modern Plastics, Aug. 1991; pp. 29-30.

Encyclopedia of Wood Joints; A Fine Woodworking Book; pp. 1-151; 1992.

Whittington's Dictionary of Plastics; Edited by James F. Carley, Ph.D., PE; pp. 443, 461; 1993.

Patent Abstract of Japan, Publication No. 07300979, Konishi et al, Nov. 1995.

Patent Mit Inter-nationalem, Die Revolution ((von Grund auf)) Fibo-Trespo, Distributed at the Domotex fair in Hannover, Germany, Jan. 1996.

International Search Report for PCT/SE 96/00256 dated Jun. 26, 1996.

Wood Handbook; Forest Products Laboratory, 1999; "Glossary pp. G-1 to 0-14", "Chapter 10, pp. 10-1 to 10-31".

U.S. Appl. No. 90/637,036, filed Oct. 2000, Pervan.

Focus, Information Till Ana Medabetare, Jan. 2001, Kahrs pa Domotex I Hmmover, Tysklm1d, Jan. 13-16, 2001.

Search Report dated Apr. 21, 2001.

Letter to the USPTO dated May 14, 2002, regarding U.S. Appl. No. 90/005,744.

Non-Final Office Action for U.S. Appl. No. 10/270,163 dated Dec. 10, 2004.

Final Office Action for U.S. Appl. No. 10/270,163 dated Jun. 2, 2005.

Non-Final Office Action for U.S. Appl. No. 10/015,741 dated Jun. 29, 2005.

Advisory Action for U.S. Appl. No. 10/270,163 dated Sep. 15, 2005.

Notice of Allowance for U.S. Appl. No. 10/015,741 dated Dec. 1, 2005.

Non-Final Office Action for U.S. Appl. No. 10/270,163 dated Dec. 14, 2005.

Final Office Action for U.S. Appl. No. 10/270,163 dated May 25, 2006.

Advisory Action for U.S. Appl. No. 10/270,163 dated Aug. 8, 2006.

Non-Final Office Action for U.S. Appl. No. 11/185,724 dated Sep. 26, 2006.

Non-Final Office Action for U.S. Appl. No. 11/483,636 dated Oct. 11, 2006.

Reexamination U.S. Appl. No. 90/007,366 dated Oct. 24, 2006.

Reexamination U.S. Appl. No. 90/007,526 dated Dec. 5, 2006.

International Search Report for Application No. PCT/SE2007/000070 dated Mar. 29, 2007.

Non-Final Office Action for U.S. Appl. No. 11/185,724 dated Apr. 19, 2007.

Non-Final Office Action for U.S. Appl. No. 11/483,636 dated Apr. 19, 2007.

Non-Final Office Action for U.S. Appl. No. 11/015,741 dated Sep. 6, 2007.

(56) References Cited

OTHER PUBLICATIONS

Non-Final Office Action for U.S. Appl. No. 11/242,127 dated Nov. 1, 2007.
Non-Final Office Action for U.S. Appl. No. 11/185,724 dated Jan. 9, 2008.
Final Office Action for U.S. Appl. No. 11/015,741 dated Feb. 26, 2008.
Non-Final Office Action for U.S. Appl. No. 11/483,636 dated Apr. 3, 2008.
Non-Final Office Action for U.S. Appl. No. 11/242,127 dated Apr. 29, 2008.
United States District Court Eastern District of Wisconsin; Order; Dated May 1, 2008.
Examiner Interview Summary for U.S. Appl. No. 11/015,741 dated May 7, 2008.
Restriction Requirement for U.S. Appl. No. 10/580,191 dated May 12, 2008.
Final Office Action for U.S. Appl. No. 11/185,724 dated Jul. 9, 2008.
Non-Final Office Action for U.S. Appl. No. 10/580,191 dated Jul. 16, 2008.
Reexamination U.S. Appl. No. 90/007,365 dated Aug. 5, 2008.
United States District Court Eastern District of Wisconsin; Judgment; Dated Oct. 10, 2008.
United States District Court Eastern District of Wisconsin; Order; Dated Oct. 10, 2008.
Final Office Action for U.S. Appl. No. 11/483,636 dated Nov. 20, 2008.
Restriction Requirement for U.S. Appl. No. 11/242,127 dated Dec. 8, 2008.
United States District Court Eastern District of Wisconsin; Order; Dated Dec. 31, 2008.
Non-Final Office Action for U.S. Appl. No. 11/242,127 dated Mar. 31, 2009.
Restriction Requirement for U.S. Appl. No. 12/010,587 dated Apr. 27, 2009.
Non-Final Office Action for U.S. Appl. No. 12/010,587 dated Jun. 23, 2009.
Non-Final Office Action for U.S. Appl. No. 11/483,636 dated Jul. 21, 2009.
Examiner Interview Summary for U.S. Appl. No. 11/185,724 dated Aug. 13, 2009.
Non-Final Office Action for U.S. Appl. No. 12/278,274 dated Sep. 24, 2009.
Final Office Action for U.S. Appl. No. 11/242,127 dated Nov. 24, 2009.
Restriction Requirement for U.S. Appl. No. 12/010,587 dated Jan. 20, 2010.
United States Court of Appeals for Federal Circuit; 2009-1107,-1122; Decided: Feb. 18, 2010.
Appeals from the United States District Court for the Eastern District of Wisconsin; Consolidated case No. 02-CV-0736 0736 and 03-CV-616; Judge J.P. Stadtmueller, 2009-1107,-1122. Revised Feb. 25, 2010.
Non-Final Office Action for U.S. Appl. No. 10/580,191 dated Mar. 10, 2010.
Non-Final Office Action for U.S. Appl. No. 11/483,636 dated Mar. 17, 2010.
Advisory Action for U.S. Appl. No. 11/242,127 dated Mar. 18, 2010.
United States Court of Appeals of the Federal Circuit; Case No. 02-CV-0736 and 03-CV-616; Mandate issued on Apr. 12, 2010; Judgment; 2 pages.
Final Office Action for U.S. Appl. No. 12/278,274 dated May 17, 2010.
Final Office Action for U.S. Appl. No. 12/010,587 dated May 25, 2010.
Advisory Action for U.S. Appl. No. 12/010,587 dated Sep. 13, 2010.
Advisory Action for U.S. Appl. No. 12/278,274 dated Sep. 27, 2010.
Final Office Action for U.S. Appl. No. 10/580,191 dated Oct. 6, 2010.
Non-Final Office Action for U.S. Appl. No. 12/278,274 dated Nov. 2, 2010.
Non-Final Office Action for U.S. Appl. No. 11/483,636 dated Dec. 7, 2010.
Advisory Action for U.S. Appl. No. 10/580,191 dated Feb. 15, 2011.
Non-Final Office Action for U.S. Appl. No. 12/010,587 dated Mar. 16, 2011.
International Search Report for Application No. PCT/EP2010/006772 dated Mar. 31, 2011.
Final Office Action for U.S. Appl. No. 12/278,274 dated Apr. 14, 2011.
Final Office Action for U.S. Appl. No. 11/483,636 dated May 24, 2011.
Non-Final Office Action for U.S. Appl. No. 13/048,646 dated May 25, 2011.
Non-Final Office Action for U.S. Appl. No. 12/966,861 dated Jul. 20, 2011.
Non-Final Office Action for U.S. Appl. No. 12/979,086 dated Aug. 3, 2011.
Non-Final Office Action for U.S. Appl. No. 12/010,587 dated Aug. 30, 2011.
Non-Final Office Action for U.S. Appl. No. 11/483,636 dated Sep. 28, 2011.
Non-Final Office Action for U.S. Appl. No. 12/240,739 dated Oct. 5, 2011.
Decision revoking the European Patent EP-B-1 276 941 dated Oct. 21, 2011.
European Patent Office Opposition Division Decision for Application No. 01906461.7 dated Oct. 21, 2011.
Final Office Action for U.S. Appl. No. 13/048,646 dated Nov. 1, 2011.
Final Office Action for U.S. Appl. No. 12/966,861 dated Jan. 20, 2012.
Final Office Action for U.S. Appl. No. 12/979,086 dated Jan. 25, 2012.
Restriction Requirement for U.S. Appl. No. 12/966,797 dated Jan. 31, 2012.
Notice of Allowance for U.S. Appl. No. 12/240,739 dated Feb. 2, 2012.
Final Office Action for U.S. Appl. No. 11/483,636 dated Feb. 7, 2012.
Non-Final Office Action for U.S. Appl. No. 12/966,797 dated Feb. 29, 2012.
Final Office Action for U.S. Appl. No. 13/204,481 dated Mar. 12, 2012.
Abandoned United States U.S. Appl. No. 13/420,282, filed Mar. 14, 2012.
Final Office Action for U.S. Appl. No. 12/010,587 dated Mar. 22, 2012.
Notice of Allowance for U.S. Appl. No. 12/966,861 dated Apr. 11, 2012.
Advisory Action for U.S. Appl. No. 13/204,481dated May 24, 2012.
Advisory Action for U.S. Appl. No. 12/010,587 dated May 30, 2012.
Non-Final Office Action for U.S. Appl. No. 13/437,597 dated Jul. 9, 2012.
Restriction Requirement for U.S. Appl. No. 13/452,183 dated Jul. 10, 2012.
Notice of Allowance for U.S. Appl. No. 12/979,086 dated Jul. 19, 2012.
Non-final Office Action for U.S. Appl. No. 12/747,454 dated Aug. 6, 2012.
Final Office Action for U.S. Appl. No. 12/966,797 dated Aug. 8, 2012.
Non-Final Office Action for U.S. Appl. No. 13/452,183 dated Aug. 8, 2012.
Non-Final Office Action for U.S. Appl. No. 13/204,481 dated Sep. 7, 2012.
Non-Final Office Action for U.S. Appl. No. 13/567,933 dated Sep. 12, 2012.

(56) References Cited

OTHER PUBLICATIONS

Non-Final Office Action for U.S. Appl. No. 12/010,587 dated Oct. 10, 2012.
Non-Final Office Action for U.S. Appl. No. 11/483,636 dated Oct. 10, 2012.
Advisory Action for U.S. Appl. No. 12/966,797 dated Oct. 18, 2012.
European Office Action dated Oct. 19, 2012.
Notice of Allowance for U.S. Appl. No. 13/437,597 dated Oct. 26, 2012.
Non-Final Office Action for U.S. Appl. No. 13/086,931 dated Nov. 7, 2012.
Non-Final Office Action for U.S. Appl. No. 13/492,512 dated Nov. 21, 2012.
Non-Final Office Action for U.S. Appl. No. 13/463,329 dated Nov. 21, 2012.
Notice of Allowance for U.S. Appl. No. 11/483,636 dated Nov. 23, 2012.
Notice of Allowance for U.S. Appl. No. 10/270,163 dated Dec. 13, 2012.
Non-Final Office Action for U.S. Appl. No. 12/966,797 dated Dec. 13, 2012.
Non-Final Office Action for U.S. Appl. No. 13/559,230 dated Dec. 20, 2012.
Non-Final Office Action for U.S. Appl. No. 13/675,936 dated Dec. 31, 2012.
Notice of Allowability for U.S. Appl. No. 11/483,636 dated Jan. 3, 2013.
Notice of Allowance for U.S. Appl. No. 12/747,454 dated Jan. 8, 2013.
Notice of Allowance for U.S. Appl. No. 13/437,597 dated Jan. 9, 2013.
Final Office Action for U.S. Appl. No. 12/010,587 dated Jan. 28, 2013.
Non-Final Office Action for U.S. Appl. No. 13/620,098 dated Feb. 8, 2013.
Final Office Action for U.S. Appl. No. 13/204,481 dated Feb. 25, 2013.
Non-Final Office Action for U.S. Appl. No. 13/492,512 dated Feb. 26, 2013.
Non-Final Office Action for U.S. Appl. No. 11/015,741 dated Mar. 13, 2013.
Final Office Action for U.S. Appl. No. 13/567,933 dated Mar. 15, 2013.
Notice of Allowance for U.S. Appl. No. 11/242,127 dated Apr. 26, 2013.
Notice of Allowance for U.S. Appl. No. 13/437,597 dated Apr. 29, 2013.
Non-Final Office Action for U.S. Appl. No. 12/747,454 dated May 10, 2013.
Notice of Allowance for U.S. Appl. No. 11/185,724 dated May 20, 2013.
Non-Final Office Action for U.S. Appl. No. 13/559,242 dated Jun. 7, 2013.
Applicant-Iniated Interview Summary for U.S. Appl. No. 13/204,481 dated Jul. 29, 2013.
Corrected Notice of Allowability for U.S. Appl. No. 11/185,724 dated Aug. 1, 2013.
Final Office Action for U.S. Appl. No. 13/086,931 dated Aug. 5, 2013.
Notice of Allowance for U.S. Appl. No. 12/966,797 dated Aug. 7, 2013.
Notice of Allowance for U.S. Appl. No. 12/010,587 dated Aug. 14, 2013.
Notice of Allowance for U.S. Appl. No. 13/559,230 dated Aug. 20, 2013.
Non-Final Office Action for U.S. Appl. No. 13/860,315 dated Aug. 26, 2013.
Notice of Allowance for U.S. Appl. No. 11/185,724 dated Sep. 3, 2013.
Non-Final Office Action for U.S. Appl. No. 13/204,481 dated Sep. 4, 2013.
Final Office Action for U.S. Appl. No. 13/620,098 dated Sep. 24, 2013.
Non-Final Office Action for U.S. Appl. No. 13/463,329 dated Sep. 25, 2013.
Notice of Allowance for U.S. Appl. No. 13/675,936 dated Sep. 25, 2013.
Supplemental Notice of Allowance for U.S. Appl. No. 12/966,797 dated Oct. 3, 2013.
Supplemental Notice of Allowance for U.S. Appl. No. 13/559,230 dated Oct. 4, 2013.
Notice of Allowance for U.S. Appl. No. 11/185,724 dated Nov. 1, 2013.
Final Office Action for U.S. Appl. No. 12/747,454 dated Nov. 6, 2013.
Restriction Requirement for U.S. Appl. No. 13/957,971 dated Nov. 12, 2013.
Notice of Allowance for U.S. Appl. No. 13/086,931 dated Nov. 19, 2013.
Notice of Allowance for U.S. Appl. No. 12/966,797 dated Dec. 5, 2013.
Architectvral Graphic Standards; Jolm Wiley & Sons, Inc.
Bojlesystemet til Junckers boliggulve, Junckers Trae for Livet.
CLIC, Ali-Nr, 110 11 640.
Fibolic Brochure, undated.
Fiboloc Literature, Mar. 1999.
FN Neuhofer Holz, "Profiles in various kinds and innovative accessories"; Certified according to DIN EN ISO 9002.
Haro Wand and Decke.
Hot Rolling of Steel; Library of Congress Cataloging in Publication Data; Roberts, William L; p. 189.
Laminat-Boden, Clever-Clickq.
New Software Simplifies Snap-Fit Design; Design News; p. 148.
Opplaering OG Autorisasjon, Fibo-Trespo, ALLOC, Lmninatgulvet som Legges Uter Lin.
Original Pergo the Free and Easy Floor.
Pergo, Clic Flooring, Laminatgolv.
Plastic Product Design; Van Nostrand Reinhold Company; pp. 256-258.
Special Verdict, Civil Case No. 02-C-0736.
The Clip System for Junckers Sports Floors, Junckers Solid Hardwood Flooring, Almex 7, p. 1/2.
The Clip System for Junckers Sports Floors, Junckers Solid Hardwood Flooring, Annex 8, p. 1/4.
Time Life Books; "Floors, Stairs, Carpets," p. 14.
Trabearbetning Anders Gronhmd, TralelmikCentrum.
Trae Pjecer; pp. 1-35.
United States District Court Eastern of Wisconsin; Pervan Testimony; Trial Day 5 (Official Transcript); pp. 1101-1292.
United States District Court North Carolina; *Pergo (Europe) AB* v *Unilin Beheer BV*, Civil. Action No. 5:08-CV-91; Joint Stipulation of Dismissal.
United States District Court of North Carolina; *Pergo (Europe) AB* v *Unilin Beheer BV*. Civil Action No. 5:08-CV-91-H3; 91-H3; Plantiffs Original Complaint for Patent Infringement.
United States District Court of North Carolina; *Pergo (Europe) AB* v *Unilin Beheer BV*. Civil Action No. 5:08-CV-91-H3: 91-H3: Answer and Counterclaim of Defendant.
Valinge Innovation AB; "Choosing the Locking System".
Webster's, Dictionary, p. 862, definition of scarf.
Final Office Action for U.S. Appl. No. 12/747,454 dated Feb. 24, 2014.
Re-Issued Pending U.S. Appl. No. 14/044,572, and Reissue Declaration Filed in Accordance With MPEP 1414, both filed Oct. 2, 2013.
Notice of Allowance for U.S. Appl. No. 13/086,931 dated Jan. 31, 2014.
Non-Final Office Action for U.S. Appl. 13/957,971 dated Feb. 20, 2014.
Notice of Allowance for U.S. Appl. No. 13/086,931 dated Mar. 18, 2014.

(56) References Cited

OTHER PUBLICATIONS

Non-final Office Action for U.S. Appl. No. 13/620,098 dated Mar. 21, 2014.
Supplemental Notice of Allowance for U.S. Appl. No. 13/086,931 dated Apr. 14, 2014.
Final Office Action for U.S. Appl. No. 13/204,481 dated Apr. 22, 2014.
Final Office Action for U.S. Appl. No. 13/463,329 dated May 16, 2014.
Restriction Requirement for U.S. Appl. No. 14/076,879 dated May 23, 2014.
Non-Final Office Action for U.S. Appl. No. 14/097,001 dated Jun. 12, 2014.
Non-Final Office Action for U.S. Appl. No. 14/098,187 dated Jun. 16, 2014.
Notice of Allowance for U.S. Appl. No. 13/567,933 dated Jun. 17, 2014.
Non-Final Office Action for U.S. Appl. No. 14/223,365 dated Jul. 3, 2014.
Notice of Allowance for U.S. Appl. No. 13/620,098 dated Jul. 22, 2014.
European Patent Office Board of Appeal Decision for Application No. 01906461.7 dated Jul. 24, 2014.
Non-Final Office Action for U.S. Appl. No. 14/086,724 dated Aug. 1, 2014.
Final Office Action for U.S. Appl. No. 13/957,971 dated Sep. 3, 2014.
Non-final Office Action for U.S. Appl. No. 12/747,454 dated Sep. 12, 2014.
Notice of Allowance for U.S. Appl. No. 13/620,098 dated Sep. 18, 2014.
Non-Final Office Action for U.S. Appl. No. 14/076,879 dated Oct. 14, 2014.
Notice of Allowance for U.S. Appl. No. 13/567,933 dated Oct. 16, 2014.
Final Office Action for U.S. Appl. No. 13/204,481 dated Oct. 30, 2014.
Notice of Allowance for U.S. Appl. No. 14/223,365 dated Nov. 5, 2014.
Advisory Action for U.S. Appl. No. 13/957,971 dated Dec. 17, 2014.
Notice of Allowance for U.S. Appl. No. 14/097,001 dated Dec. 24, 2014.
Notice of Allowance for U.S. Appl. No. 14/098,187 dated Dec. 26, 2014.
Notice of Allowance for U.S. Appl. No. 13/463,329 dated Dec. 31, 2014.
Final Office Action for U.S. Appl. No. 14/086,724 dated Jan. 16, 2015.
Notice of Allowance for U.S. Appl. No. 13/860,315 dated Jan. 20, 2015.
Non-Final Office Action for U.S. Appl. No. 13/957,971 dated Jan. 30, 2015.
Notice of Allowance for U.S. Appl. No. 13/567,933 dated Feb. 4, 2015.
Final Office Action for U.S. Appl. No. 14/076,879 dated Mar. 4, 2015.
Notice of Allowance for U.S. Appl. No. 13/860,315 dated Mar. 5, 2015.
Non-Final Office Action for U.S. Appl. No. 13/204,481 dated Mar. 25, 2015.
Non-Final Office Action for U.S. Appl. No. 14/456,755 dated Mar. 27, 2015.
Notice of Allowance for U.S. Appl. No. 13/860,315 dated Apr. 6, 2015.
Non-Final Office Action for U.S. Appl. No. 14/044,572 dated Apr. 6, 2015.
Notice of Allowance for U.S. Appl. No. 14/098,187 dated Apr. 8, 2015.
Notice of Allowance for U.S. Appl. No. 14/086,724 dated Apr. 15, 2015.
Notice of Allowance for U.S. Appl. No. 14/097,001 dated Apr. 15, 2015.
Non-Final Office Action for U.S. Appl. No. 14/658,954 dated Apr. 24, 2015.
Final Office Action for U.S. Appl. No. 14/076,879 dated Apr. 24, 2015.
Notice of Allowance for U.S. Appl. No. 13/048,646 dated May 14, 2015.
Notice of Allowance for U.S. Appl. No. 13/567,933 dated May 22, 2015.
Notice of Allowance for U.S. Appl. No. 14/086,724 dated Jun. 1, 2015.
Final Office Action for U.S. Appl. No. 13/957,971 dated Aug. 6, 2015.
Notice of Allowance for U.S. Appl. No. 13/860,315 dated Aug. 21, 2015.
Notice of Allowance for U.S. Appl. No. 14/098,187 dated Sep. 10, 2015.
Notice of Allowance for U.S. Appl. No. 13/567,933 dated Sep. 15, 2015.
Notice of Allowance for U.S. Appl. No. 14/097,001 dated Sep. 16, 2015.
Final Office Action for U.S. Appl. No. 13/204,481 dated Sep. 21, 2015.
Final Office Action for U.S. Appl. No. 14/076,879 dated Oct. 22, 2015.
Final Office Action for U.S. Appl. No. 14/456,755 dated Oct. 27, 2015.
Final Office Action for U.S. Appl. No. 14/658,954 dated Nov. 9, 2015.
Non-Final Office Action for U.S. Appl. No. 13/492,512 dated Nov. 17, 2015.
Advisory Action for U.S. Appl. No. 13/957,971 dated Nov. 30, 2015.
Notice of Allowance for U.S. Appl. No. 13/860,315 dated Dec. 9, 2015.
Non-Final Office Action for U.S. Appl. No. 13/957,971 dated Dec. 18, 2015.
Restriction Requirement for U.S. Appl. No. 14/844,877 dated Dec. 31, 2015.
Non-Final Office Action for U.S. Appl. No. 14/821,293 dated Feb. 2, 2016.
Notice of Allowance for U.S. Appl. No. 13/204,481 dated Feb. 3, 2016.
U.S. Appl. No. 15/043,083, filed Feb. 12, 2016.
Advisory Action for U.S. Appl. No. 14/658,954 dated Mar. 3, 2016.
Final Office Action for U.S. Appl. No. 14/044,572 dated Mar. 18, 2016.
Notice of Allowance for U.S. Appl. No. 14/456,755 dated Apr. 6, 2016.
U.S. Appl. No. 15/131,977, filed Apr. 18, 2016.
Notice of Allowance for U.S. Appl. No. 13/957,971 dated May 9, 2016.

* cited by examiner

FLOORING MATERIAL COMPRISING FLOORING ELEMENTS WHICH ARE ASSEMBLED BY MEANS OF SEPARATE FLOORING ELEMENTS

CROSS-REFERENCE TO RELATED APPLICATIONS

This application is a continuation of and claims priority to U.S. application Ser. No. 11/185,724 filed Jul. 21, 2005 which is a divisional application of U.S. application Ser. No. 10/802,779, filed Mar. 18, 2004, which, in tum, is a divisional application of U.S. application Ser. No. 09/806,994, filed May 31, 2001, which is a §371 application of International Application Ser. No. PCT/SE99/01699, claiming the benefit of Swedish Application No. 9803379-8, filed Oct. 6, 1998, the entire disclosures of which are herein incorporated by reference in their entirety.

The present invention relates to a flooring material comprising board shaped flooring elements which are assembled by means of separate joining profiles.

Prefabricated floor boards provided with tongue and groove at the edges are quite common nowadays. These can be installed by the average handy man as they are very easy to install. Such floors can, for example, be constituted of solid wood, fibre board or particle board. These are most often provided with a surface layer such as lacquer, or some kind of laminate. The boards are most often installed by being glued via tongue and groove. The most common types of tongue and groove are however burdened with the disadvantage to form gaps of varying width between the floor boards in cases where the installer hasn't been thorough enough. Dirt will easily collect in such gaps. Moisture will furthermore enter the gaps which will cause the core to expand in cases where it is made of wood, fibre board or particle board, which usually is the case. The expansion will cause the surface layer to rise closest to the edges of the joint which radically reduces the useful life of the floor since the surface layer will be exposed to an exceptional wear. Different types of tensioning devices, forcing the floor boards together during installation can be used to avoid such gaps. This operation is however more or less awkward. It is therefore desirable to achieve a joint which is self-guiding and thereby automatically finds the correct position. Such a joint would also be possible to utilise in floors where no glue is to be used.

Such a joint is known through WO 94/26999 which deals with a system to join two floor boards. The floor boards are provided with a locking device at the rear sides. It is, however, shown in the figures with accompanying description that the floor boards are provided with profiles on the lower side at a first long side and short side. These profiles, which extends outside the floor board itself, is provided with an upwards directed lip which fits into grooves on the lower side of a corresponding floor board. These grooves are arranged on the second short side and long side of this floor board. The floor boards are furthermore provided with a traditional tongue and groove on the edges. The intentions are that the profiles shall bend downwards and then to snap back into the groove when assembled. The profiles are integrated with the floor boards through folding or alternatively, through gluing.

The invention according to WO 94/26999 is however burdened with the disadvantage that the profiles are located in a very exposed position and will easily be damaged during handling. According to WO 94/26999, the floor boards may be joined without the lip having to touch the contact surface of the groove at tolerances as small as ±0.2 mm. The profiles are easily deformed during manufacturing, transport and installation of the relatively heavy floor boards since the profiles are located in a very exposed position. Further deformation of the delicate joining profiles is probable since the intentions are that it should be possible to disassemble and reinstall the floor boards according to WO 94/26999. Such deformation will obstruct, and in serious cases even make assembly of the floor boards impossible.

It seems, from WO 94/26999 to be desired to have a clearance between the contact surfaces of the lip and the groove. A tolerance of ±0.2 mm is mentioned in the application. The clearance seems to be marked Δ in the Figures. Such a clearance will naturally cause undesired gaps between the floor boards. Dirt and moisture can penetrate into these gaps.

Another disadvantage is that the tongue, located on two of the edges, must be tooled from the base material which will loss of the surface layer. Such a surface layer will most often be constituted of thermosetting laminate and is normally the most costly part of a laminate floor. A surface layer of thermosetting laminate will furthermore cause an extensive wear on the tools used for milling.

Another disadvantage becomes clear when performing a life-cycle analysis on the floor boards according to WO 94/26999. According to one preferred embodiment of WO 94/26999, the joining profile is constituted of aluminium. Since it constitutes a part integrated with the floor board it will be practically impossible to recycle the floor board without a very labour-intensive process. The inevitable cutting of the floor board will also be very difficult, utilising common tools, as both aluminium, thermosetting laminate and core will have to be cut at the same time.

It is also known through WO 97/47834 to manufacture a joint where the floor boards are joined so that they are locked together in the horizontal direction. According to this invention a traditional tongue has been provided with heel on the lower side. The heel has a counterpart in a recess in the groove of the opposite side of the floor board. The lower cheek of the groove will be bent away during the assembly and will then snap back when the floor board is in the correct position. The snap-joining parts, in.e. the tongue and groove, is in opposite to the invention according to WO 94/26999 above, where they are constituted by separate parts, seems to be manufactured monolithically from the core of the floor board. WO 97/47834 does also show how the tongue and groove with heels and recesses according to the invention is tooled by means of cutting machining. This invention does also have the disadvantage that the tongue, and particularly, the lower cheek of the groove will easily be damaged during normal handling even though they protrudes less than in the invention according to WO 94/26999 above.

Also WO 97/47834 does have the disadvantage that both tongue and groove will have to be tooled in a way that causes loss of the costly top surface. This tooling will also cause an extensive wear on tools used.

The invention according to WO 97/47834 presumes a certain amount of resilient properties in the core material. The material normally used is not very suitable if a resilient property is desired. MDF (medium density fibre board) or HDF (high density fibre board) should according to WO 97/47834 be suitable as core material. The resilient properties of these materials are however, rather poor, whereby the risk for crack formation, parallel to the top surface, ought to be great.

The invention according to WO 93/13280 deals with a form of clip intended to be used for holding floor boards together. The floor boards are, besides being provided with a traditional tongue and groove, with known disadvantages, also provided with a single groove on the lower side of the floor board. The floor boards rests on the clip whereby a great number of clips will have to be used as the floor otherwise will be resilient. The distance formed between the floor boards and the surface beneath will furthermore cause acoustic resonance. This will give the floor a noisy character and a higher sound level. This is not desired.

The above mentioned problems are solved through the present invention, whereby a floor that endures handling, demands a minimum of machining of the decorative top surface and is easy to install has been achieved. Accordingly, the invention relates to a flooring material comprising board shaped floor elements with a mainly square or rectangular shape. The floor elements are provided with edges, a lower side and a decorative upper surface. The floor elements are intended to be joined by means of separate joining profiles. The invention is characterised in that all four edges of the floor elements are provided with one notch-like groove each. The grooves are arranged parallel to its respective edge. The joining profiles are provided with lips arranged in pairs. The lips are intended to each be received by one of the grooves so that the floor element, with the grooves at the adjacent edges will be guided or fixed vertically via the lips of a joining profile. The lips are joined by a middle section of the joining profile. The grooves are furthermore provided with an undercut while the lips are provided with hooks that matches the undercut. Adjacent floor elements will hereby be guided or fixed horisontally via the undercuts and the hooks. According to one alternative the lips are provided with gripping hooks. Such gripping hooks can be used in grooves without undercut by making them sharp edged.

The grooves are suitably provided with a support for the middle section of the joining profiles. It will thereby be possible to make this embodiment dismountable where it is chosen to install the floor without using glue.

The joining profiles are suitably shaped as extended profiles which suitably are manufactured through extrusion which is a well known and rational method. The joining profiles are suitably shaped as extended lengths or rolls which can be cut to the desired length. The length of the joining profiles considerably exceeds the length of a floor element, before being cut. An advantage with such long profiles is that they can be laid over the whole width of the floor and will thereby reduce the risk for deviations and gaps in the floor since it bridges the lateral joints of the floor. Such bridging of the lateral joints can of course be used even if the joining profiles have the same length as, or is shorter than the floor elements. Shorter pieces of joining profiles is suitably used when it comes to the lateral joints of the floor. The floor elements may alternatively be provided with traditional tongue and groove in the lateral joint edges.

The flooring material comprising the floor elements and joining profiles above is very suited for installations of floors where no glue is needed. It is, of course possible to use glue or double-faced adhesive tape in order to make the installation completely permanent. The glue or tape is then suitably placed on the surfaces of the joining profile located between the lips and/or on the edges of the floor element.

The joining profiles are in the present invention a separate part in opposite to earlier known and cited flooring materials where the joining is made through tongue and groove, profiles or heels. This will give great advantages when handling the floors in connection to manufacturing, transport and installation as traditional joining parts normally are very delicate and sensitive to blows. These parts must, of manufacturing technological reasons, be made of fibre board, particle board or thin aluminium sheets which all are easy to either break or deform. This will normally lead to that the floor elements has to be rejected. Joining profiles according to the present invention can be made of a multitude of materials and by means of many different manufacturing methods. Among the most suitable methods can, however, be mentioned injection moulding for the plus-shaped embodiment of a joining profile and extrusion for the extended embodiment of joining profile. Suitable materials are thermoplastic materials such as poly olefins, polystyrene, polyvinyl chloride or acrylnitril-butadiene-styrene-copolymer. These can suitably be filled with for example wood powder or time in order to increase the dimension stability as well as increasing the adhesion when being glued.

The invention may also relate to a flooring material comprising board shaped floor elements with a mainly square or rectangular shape. The floor elements are provided with edges, a lower side and a decorative upper surface. The floor elements are joined by means of separate joining profiles. The characterising features in this embodiment are that the floor elements are provided with grooves on at least two opposite sides. The grooves are arranged parallel to its respective edge on the lower side of the floor element. The joining profiles are provided with lips arranged in pairs, which lips are intended to each be received by one of the grooves of the floor elements so that two adjacent floor elements with the grooves at the adjacent edges are guided or fixed horizontally via the lips of a joining profile. The lips are joined by a middle section of the joining profile.

The grooves are placed on a distance from the closest edge of less than half, preferably less than one quarter of the width of the floor element.

The floor elements are suitably provided with grooves on all four edges. The distance between each groove and the closest edge is mainly the same.

The section located between the edges and its closest eroove is preferably of thickness which is thinner than the largest thickness of the floor through a recess located on the lower side.

The edges are suitably provided with a vertical guiding by providing a first edge with a preferably V-shaped longitudinal groove with a depth less than 1.8 times, preferably 0.9 times the greatest thickness of the floor. An opposite edge, as related to the first edge, is provided with a matching protruding profile.

The edges are alternatively provided with a vertical guiding by providing two adjacent edges with each a preferably V-shaped longitudinal groove with a depth of less than 1.8 times, preferably less than 0.9 times the greatest thickness of the floor element. The two remaining edges are provided with a protruding profile that matches the longitudinal groove.

The distance between the, in pairs, arranged lips of the joining profile is preferably somewhat smaller than the distance between the grooves placed on each side, and closest to, the joint between two adjacent floor elements. The joining profile will hereby exert a tensioning force on the joint.

The joining profiles are suitably manufactured as extended lengths, through extrusion which is a well-known and rational manufacturing method. The joining profiles are shaped as extended lengths or rolls which can be cut to the desired length. The length of the joining profiles considerably exceeds the length of a floor element. One advantage with such long joining profiles is that they can be laid over the whole width of a floor and will thereby reduce the risk for deviations and gaps in the floor as it bridges the lateral joints in the floor. Such bridging of the lateral joints can of course be used even if the joining profiles have the same length as, or is shorter than the floor elements. Shorter pieces of joining profiles is suitably used when it comes to the lateral joints of the floor. These are suitably installed gradually as every new floor element is added to a row. The floor elements may alternatively be provided with traditional tongue and groove in the lateral joint edges.

According to one variation of the embodiment above, the joining profiles are intended to be placed in corner where four floor elements meets. The joining profiles is shaped as a plus with four cheeks, as seen from above. The first three cheeks, which together with the fourth forms the plus-shaped joining profile, are provided two lips, arranged in pairs, each. The lips are intended to be placed on each one side of a joint. The fourth cheek is provided with only one lip placed on one side of the joint.

The plus-shaped joining profiles are best suited for installation of square floor elements and will automatically give an excellent guiding of both the lateral and longitudinal joints. These are suitably provided with cheeks that are only somewhat shorter than the half the short side of the floor element. The cheek length is calculated as, from the centre of the joining profile to its outer edge. The plus-shaped joining profiles are also suited for installation of rectangular floor elements in cases where the lateral joints are to coincide. The length of the cheeks are hereby somewhat shorter than half the width of the floor element. Extended profiles can be cut and installed in the intermediate space on the long side between two plus-shaped joining profiles to reinforce the long side joint. In cases where the lateral joints are to be displaced from row to row it is possible to use a T-shaped joining profile which has three cheeks instead of four. This profile is suitably also provided with cheeks of length somewhat shorter than the half the width of the floor element. Flooring materials comprising the floor elements and joining profiles above are very suited where it is desired to install floors without having to use glue. It is of course possible to use glue or double-faced adhesive tape in order to make the installation irreversibly permanent. The glue or the tape is then suitably applied to the surfaces located between the lips, and on the edges.

The joining profiles are, unlike earlier known and herein mentioned flooring materials where the joining is achieved through tongue and groove, profiles or heels, a separate part. This will give great advantages when handling the floors in connection to manufacturing, transport and assembly as the traditional joining parts are very delicate and sensitive to blows. These parts must, of manufacturing technological reasons, be made of fibre board, particle board or thin aluminium sheets which all are easy to either break or deform. This will normally lead to that the floor elements has to be rejected. Joining profiles according to the present invention can be made of a multitude of materials and by means of many different manufacturing methods. Among the most suitable methods can, however, be mentioned injection moulding for the plus-shaped embodiment of a joining profile and extrusion for the extended embodiment of joining profile. Suitable materials are thermoplastic materials such as poly olefins, polystyrene, polyvinyl chloride or acrylnitril-butadiene-styrene-copolymer. These can suitably be filled with for example wood powder or lime in order to increase the dimension stability as well as increasing the adhesion when being glued.

The invention is described further together with enclosed figures showing different embodiments of the invention whereby, FIG. 1 shows, in perspective view, seen from below, an embodiment of a floor element 1 to a flooring material.

FIGS. 2*a*-2*c* shows in exploded view and in cross-section different embodiments of a flooring material.

Figure 4:
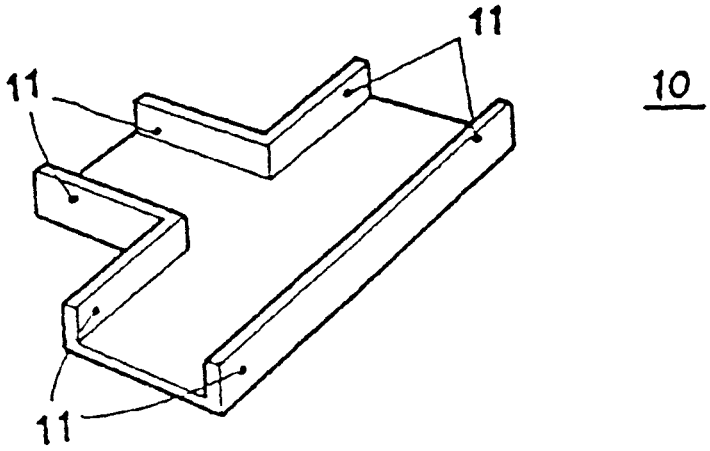
FIG. 4 shows another embodiment of a joining profile 10 to a flooring material.
Figure 6:
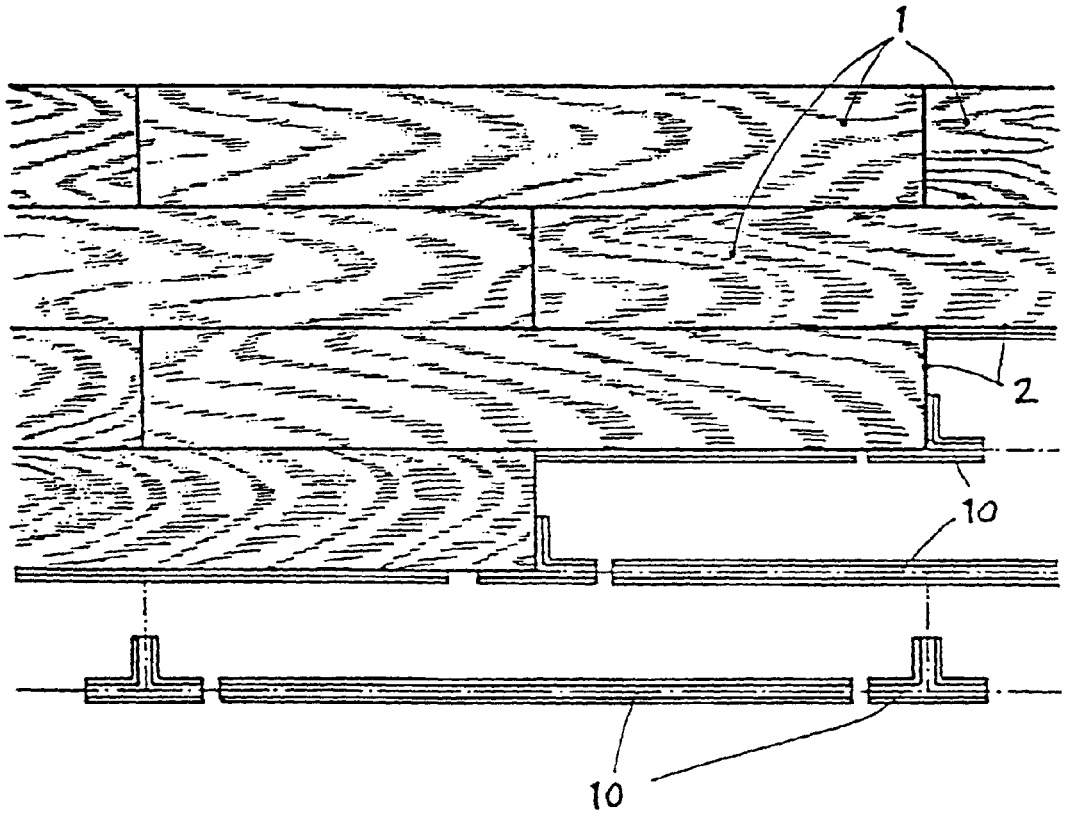

FIG. 6 shows a flooring material according to the invention where rectangular floor elements 1 and T-shaped joining profiles 10, as shown in FIG. 4 and extended joining profiles 10 are used. The floor is only partly installed in order to facilitate understanding of the function.

FIGS. 7*a*-*d* shows different preferred embodiments of joints with floor elements I which are joined by means of joining profiles 10 via notch-shaped grooves 4 in the edges 2 of the floor boards 1.

Figure 1:
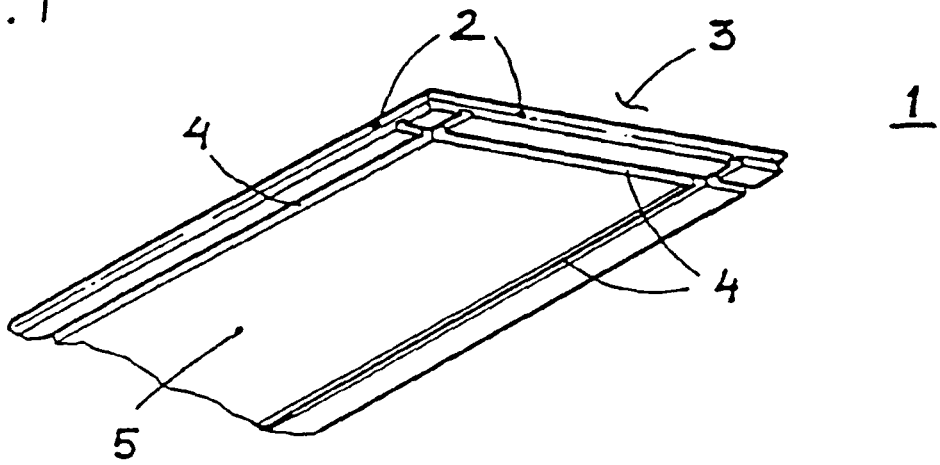

Accordingly, FIG. 1 shows, in perspective seen aslant from below, an embodiment of a floor element 1 to a flooring material. The floor element 1 has rectangular shape and is provided with edges 2, a lower side 5 and a decorative upper surface 3. The floor elements 1 are joined by means of separate joining profiles 10 (FIGS. 2-6). The floor element 1 is provided with a groove 4 at each of the edges 2. The grooves 4 are arranged parallel to its respective edge 2. The joining profiles 10 (e.g. 2-6) are provided with lips 11 (FIGS. 2-6), arranged in pairs, which each are intended to be received by one of the grooves 4 of the floor element 1. Two adjacent floor elements 1 with the grooves 4 at the adjacent edges 2 are guided or locked horizontally by means of the lips 11 of the joining profile 10. The floor elements 1 most often comprises a core to which an upper decorative layer has been applied. The core most often consists of wood particle or fibre bonded together by glue or resin. It might be advantageous to treat the surface closest to the joint in cases where the floor will be exposed to moisture, since the wood in the core is sensitive to moisture. This surface treatment may suitably include resin, wax or some kind of lacquer. It is not necessary to coat the joint if it is to be glued since the glue itself will protect the core from moisture penetration. The decorative upper surface 3 is constituted by a decorative paper impregnated with melamine-formaldehyde resin. One or more layers of so-called overlay papers made of α-cellulose, impregnated with melamine-formaldehyde resin are possibly placed on top of this. The abrasion resistance can be improved further by sprinkling one or more of the layers with hard particles of for example α-aluminium oxide, silicon carbide or silicon oxide in connection to the impregnation. The lower side 5 may suitably be coated with lacquer or a layer of paper and resin.

Figure 2A:
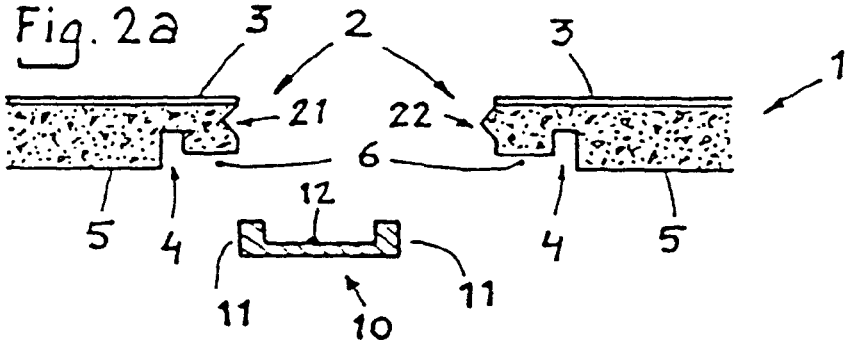
Figure 2B:
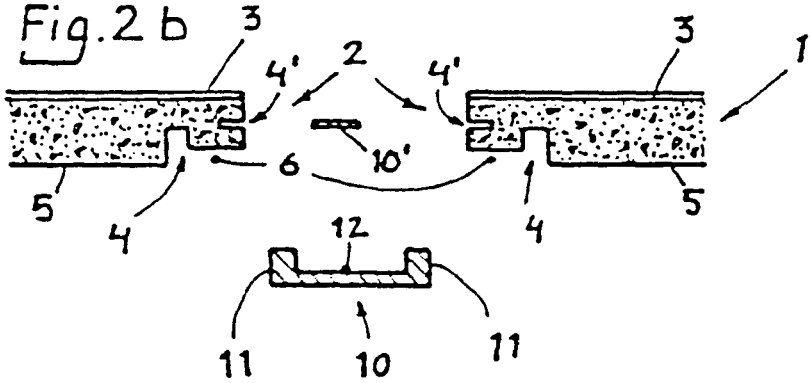
Figure 2C:
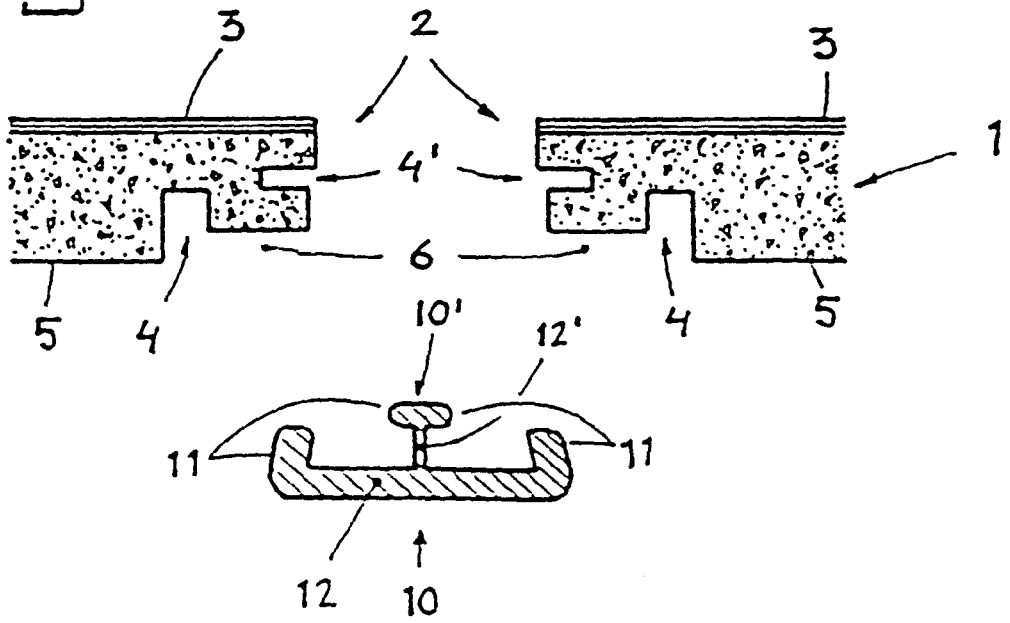

FIGS. 2*a*-2*c* shows in exploded view and in cross-section, different embodiments of a flooring material. The floor elements 1 are provided with edges 2, a lower side 5 and a decorative upper surface 3. The floor elements 1 are joined by means of separate joining profiles 10. The floor elements 1 are at two opposite edges 2 provided with one groove 4 each. The grooves 4 are arranged parallel to its respective edge 2. The grooves 4 are arranged on the lower side 4 at a distance from the closest edge 2 of the less than one fourth of the width of the floor element 1. The section located between the edges 2 and their respective closest groove 4 has a thickness which is smaller than the greatest thickness of the floor board 1 through a recess 6 located on the lower side 5. The thickness of the floor is normally between 5 and 15 mm whereby a suitable difference in thickness at the recess 6 and the main floor thickness is 1-5 mm. The edges 2 are provided with a vertical guiding by a providing a first edge with a V-shaped longitudinal groove 21 (FIG. 2*a*) with a depth less 0.9 times the greatest floor thickness. The opposite edge 2 is provided with a matching profile 22 (FIG. 2*a*). The joining profiles 10 are provided with lips 11 arranged in pairs, which lips each are intended to be received by each one groove 4 of the floor elements 1 so that to adjacent floor elements 1 with the grooves 4 at the adjacent edges 2 are guided or fixed horizontally via the lips 11 of a joining profile 10. The floor elements 1 may, instead of being provided with V-shaped grooves 21 with matching profile 22, alternatively be provided with a notch-like groove 4' (FIGS. 2*b*-2*c*) in all four edges 2, which grooves 4' (FIGS. 2*b*-2*c*) are intended to receive each one of the lips 11 of a second joining profile 10' The second joining profile 10' may either be a separate part (FIG. 2*b*) or be joined with the joining profile 10 via a rib 12' (FIG. 2*c*) The lips 11 are connected by a middle section 12 of the joining profile 10. The distance between the, in pairs. arranged lips 11 of the joining profile 10 is somewhat smaller than the distance between the grooves 4 arranged on each one side of, and closest to, the joint between two adjacent floor elements 1. The floor elements 1 will thereby be forced together whereby gaps are avoided. The joining profiles 10 and 10' are manufactured as extended lengths or rolls which may be cut into the desired length during installation. These lengths considerably exceeds the length of the floor elements 1. The embodiments shown in the FIGS. 2*a*-*c* all gives a minimum of machining a minimum of material loss during manufacturing.

Figure 3:
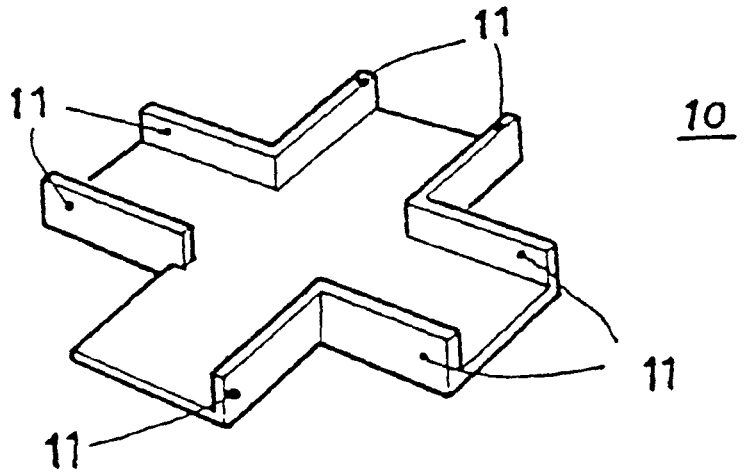
FIG. 3 shows an embodiment of a joining profile 10 to a flooring material.

FIG. 3 shows, in perspective view seen from above, an embodiment of a joining profile 10 to a flooring material. The floor elements 1 are, as shown in FIG. 1, provided with edges 2, a lower side 5 and a decorative upper surface 3. The floor elements 1 are joined by means of separate joining profiles 10. The floor elements 1 are, as shown in FIG. 1, provided with one groove 4 each, at two opposite edges 2. The grooves 4 are arranged parallel to its respective edge 2. The grooves 4 are placed on the lower side 5 at a distance from the closest edge 2 of less than one fourth of the width of the floor element 1. The section located between the edges 2 and their respective closest groove 4 has a thickness which is smaller than the greatest thickness of the floor board 1 through a recess 6 located on the lower side 5. The thickness of the floor is normally between 5 and 15 mm whereby a suitable difference in thickness at the recess 6 and the main floor thickness is 1-5 mm. The edges 2 may, as shown in the FIGS. 2*a*-*c*, be provided with a vertical guiding through a V-shaped groove 21 (FIG. 2*a*) with matching profile 22 (FIG. 2*a*) or by a notch-like grooves 4' (FIGS. 2*b*-*c*) in all four edges 2 with a matching second joining profile 10' (FIGS. 2*b*-*c*). The plus-shaped joining profile 10 (FIG. 3) is provided with lips 11 arranged in pairs, which lips 11 each are intended to be received by one of the grooves 4 of the floor element 1 so that adjacent floor element 1, with the grooves at the adjacent edges 2 are guided or fixed horizontally via the lips 11 of a joining profile 10. The joining profile is intended to be placed in the corner where four floor elements 1 meet. The joining profile 10 is, as seen from above shaped as a plus with four cheeks, where the first three cheeks, which together with the fourth one forms the plus-shaped joining profile 10, is provided with two lips 11 arranged in pairs each, which are intended to be placed at either side of a joint. The fourth cheek is provided with only one lip 11 arranged on one side of the joint. The reason why the fourth cheek is provided with only one lip 11 is that the last floor element 1 joined with such a joining profile 10 must be slided in from the side in cases where the floor elements 1 are provided with a vertical guiding as shown in the FIGS. 2*a*-*c*. The joining profile 10 as shown in FIG. 3 is used on floors where both longitudinal and lateral joints is to coincide.

FIG. 4 shows in perspective another embodiment of a joining profile 10 to a flooring material. The joining profile 10 corresponds in the main to the one described in connection to FIG. 3. The joining profile 10 showed in FIG. 4 is however provided with only three cheeks and can thereby be described as T-shaped. The joining profile 10 as shown in FIG. 3 is used in floors where only the longitudinal or lateral joints is to coincide.

Figure 5:
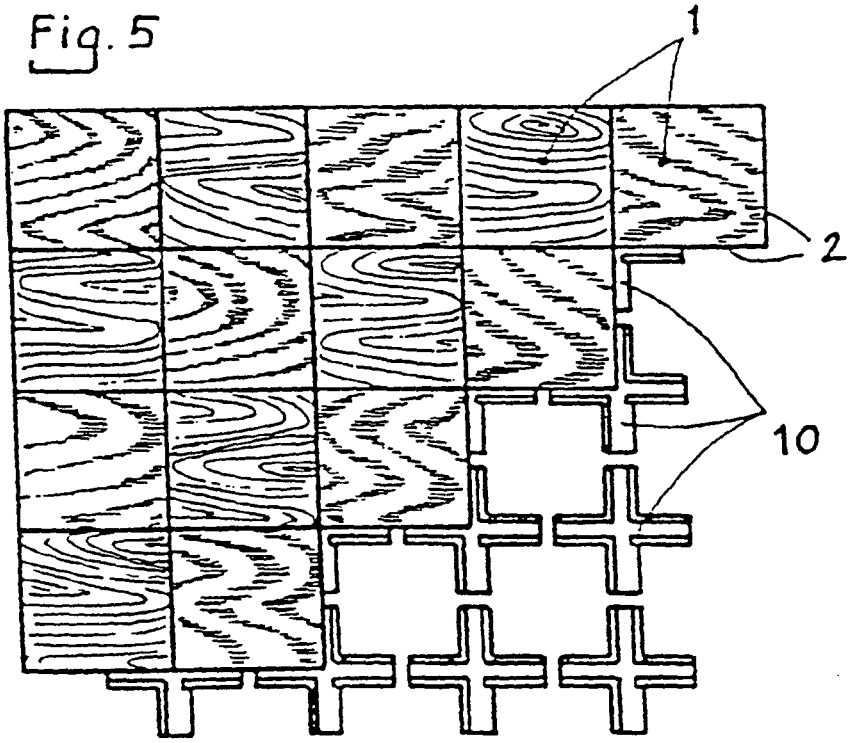
FIG. 5 shows a flooring material according to the invention where square floor elements 1 and plus-shaped joining profiles 10 shown in FIG. 3 is shown. The floor is only partly installed in order to facilitate understanding of the function.

FIGS. 5 and 6 shows a flooring material according to the invention where square and rectangular floor elements 1 respectively and plus-shaped and T-shaped joining profiles 10 respectively as shown in FIGS. 3 and 4 are used. The flooring material is only partly installed in order to facilitate understanding of the function. The plus-shaped profiles are best suited when installing square floor elements 1 and will automatically an excellent guiding of the joints in both longitudinal and lateral direction. These are suitably provided with cheeks being somewhat shorter than half the side of a floor element 1. The length of a cheek is calculated as, from the centre of the joining profile 10 to its outer edge. The plus-shaped joining profiles are also suited for installation of rectangular floor elements 1 in cases where coinciding lateral joints is desired. The length of the cheeks is here somewhat shorter than the short side edge of the floor element 1. Extended profiles 10 can be cut and mounted in the intermediate space between two plus-shaped profiles 10 in order to reinforce the long side joint of the floor board 1.

It is possible to use a T-shaped joining profile which has three cheeks instead of four in cases where a position of the lateral joints shifting from row to row (FIG. 6) is desired. This installation pattern is most often used when installing rectangular floor elements 1. The length of the cheeks is also here, somewhat smaller than half the short side of the floor elements 1. The flooring material comprising the above floor elements 1 and joining profiles 10 are very suited for installations where it is desired to avoid use of glue. It is, of course, possible to use glue or double faced adhesive tape in order to make the installation completely permanent. The glue or tape is then suitably applied to the surfaces of the joining profile 10 that are located between the lips 11 and on the edges 2 (FIG. 2).

It is also possible to use only extended profiles 10 when installing floor elements 1. These are then suitably cut to cover the full width of the floor. The joining profiles 10 will then extend in the same direction as the rectangular floor elements 1. Small pieces are cut from joining profiles 10. These small pieces are placed in the lateral joints as every new floor element 1 is installed. It is suitable to bring these small pieces from below into the joint between two assembled floor boards 1.

Figure 7A:
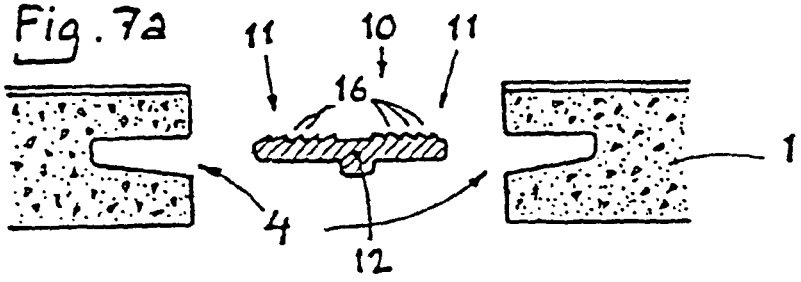
Figure 7B:
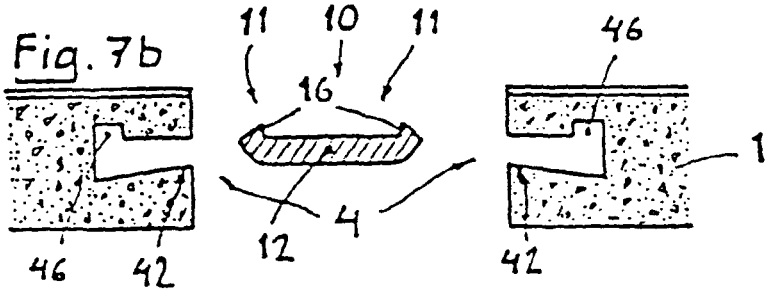
Figure 7C:
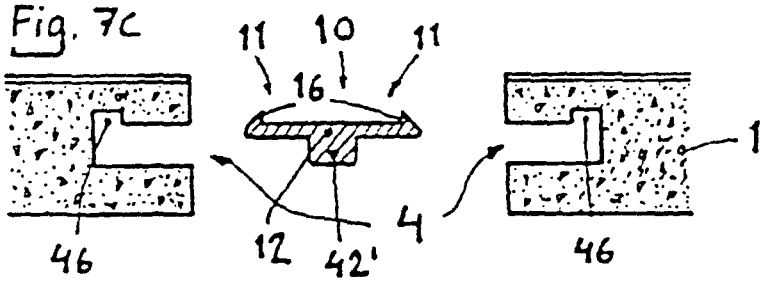
Figure 7D:
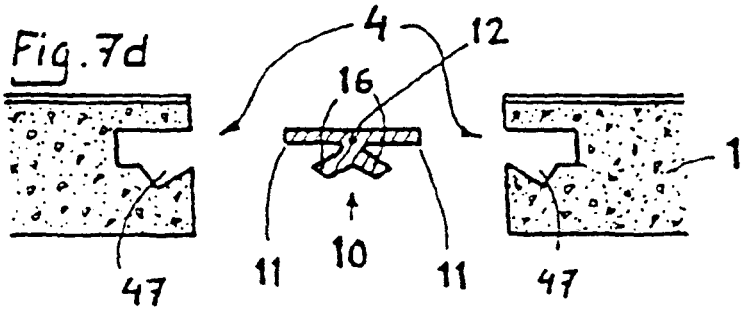

FIGS. 7*a*-*d* shows different embodiments of joints with floor elements 1 which are joined by means of joining profiles 10 via notch-shaped grooves 4 in the edges 2 of the floor boards 1. The floor boards 1 are provided with notch-shaped grooves 4 in all four edges 2. The grooves 4 are each intended to receive one of the lips 11 of the joining profile 10. The lips 11 are provided with gripping hooks 16. The floor can be made snap-joinable by providing the grooves 4 with a undercut 46 (FIGS. 7*b-c*) and by providing the lips with matching hooks 16 (FIGS. 7*b-c*). In order to make the joint dismountable, which can be advantageous even if the floor elements are to be glued, the grooves 4 are provided with a support 42 (FIG. 7*b*) for the middle section 12 of the joining profile 10. The middle section 12 can alternatively be provided with a support 42' (FIG. 7*c*). Such a floor element 1 is then dismounted by lifting it slightly along the free edge 2, whereby the hook will be disengaged from the undercut 46. The simplest way to achieve such undercuts 46 are through broaching or laser cutting. The floor elements 1 may alternatively be joined through a more shallow undercut 47 (FIG. 7*d*) which can be achieved with traditional methods such as milling. The embodiments shown in FIGS. 7*a-d* does all give a minimum of cutting and lost material during manufacturing. The joining profiles 10 used in the embodiments shown in FIGS. 7*a-d* are also manufactured in extended lengths or rolls which are cut to the desired length in connection to the installation of the floor. The joining profiles 10 and/or the floor elements 1 may, of course, be coated with glue or adhesive double-faced tape.

The invention is not limited by the embodiments shown since they can be varied in different ways within the scope of the invention.

The invention claimed is:

1. Flooring material comprising board shaped floor elements with a rectangular oblong shape and a thickness of between 5 and 15 millimeters, the floor elements made of a base material and comprising edges, a lower side and a decorative upper surface, the floor elements comprising a core to which an upper decorative layer has been applied, the decorative upper surface comprising the upper decorative layer, wherein the upper decorative layer comprises a decorative paper impregnated with melamine-formaldehyde resin, wherein the flooring material further comprises joining profiles, the joining profiles being separate from the base material of the floor element, wherein the edges and joining profiles allow for two of the floor elements to become mutually fixed adjacent to each other at their respective adjacent edges, such that a horizontal fixation as well as vertical fixation is effective, wherein the horizontal fixation prevents moving apart of the adjacent floor elements in a horizontal direction when in an installed configuration, wherein the respective adjacent edges comprise each a respective groove, the respective grooves being positioned at least partially opposite each other and defining a common cavity, wherein the vertical fixation is obtained through at least one of the joining profiles, the at least one of the joining profiles being located in the cavity and being shorter than the respective adjacent edges, wherein the at least one of the joining profiles is not involved in the horizontal fixation.

2. The flooring material of claim 1, wherein the horizontal as well as vertical fixation is reversible in that the respective adjacent edges allow adjacent floor elements to become dismounted from the installed configuration.

3. The flooring material of claim 2, wherein the respective adjacent edges allow the adjacent floor elements to become dismounted by lifting one of the floor elements in respect to the other such that portions effective in the horizontal fixation become unlocked.

4. The flooring material of claim 1, wherein the at least one of the joining profiles is formed from an extruded or injection molded plastic material.

5. The flooring material of claim 1, wherein the at least one of the joining profiles is formed from a thermoplastic material selected from a list consisting of polyolefin, polystyrene, polyvinyl chloride and acrylnitril-butadiene-styrene-copolymer.

6. The flooring material of claim 1, wherein the at least one of the joining profiles is formed from a plastic material.

7. The flooring material of claim 6, wherein the plastic material comprises a filler material increasing the dimensional stability of the at least one of the joining profiles.

8. The flooring material of claim 1, wherein the respective adjacent edges and the at least one of the joining profiles are located at adjacent short ends of the floor elements.

9. The flooring material of claim 1, wherein the core comprises a wood particle or wood fiber bonded together by glue or resin.

10. The flooring material of claim 1, wherein the decorative upper surface further comprises one or more layers of overlay papers impregnated with melamine-formaldehyde resin, the one or more layers being placed on top of the decorative paper.

11. The flooring material of claim 1, wherein the at least one of the joining profiles comprises gripping hooks at its upper surface.

12. The flooring material of claim 1, wherein the opposite grooves have a depth smaller than 0.9 times the thickness of the floor elements.

13. Flooring material comprising board shaped floor elements with a rectangular oblong shape, the floor elements made of a base material and comprising edges, a lower side and a decorative upper surface, wherein the flooring material further comprises joining profiles, the joining profiles being separate from the base material of the floor element, wherein the edges and joining profiles allow for two of the floor elements to become mutually fixed adjacent to each other at their respective adjacent edges, such that a horizontal fixation as well as vertical fixation is effective, wherein the horizontal fixation prevents the moving apart of the adjacent floor elements in a horizontal direction when in an installed configuration, wherein the respective adjacent edges comprise each a respective groove, the respective grooves defining a common cavity, wherein the vertical fixation is obtained through at least one of the joining profiles, the at least one of the joining profiles being at least partly located in the cavity, wherein chambers are present in the cavity between a contour of the at least of the joining profiles and the walls of the grooves, wherein the flooring material at the edges further comprises lips and downwardly open grooves formed at the lower side and being parallel to the respective edges, wherein the horizontal fixation is obtained through an interaction of the lips and grooves formed at the lower side, wherein the edges with the downwardly open grooves, comprise a section, located between the edge and the downwardly open groove, which is of a thickness that is thinner than a largest thickness of the floor elements, through a recess located on the lower surface.

14. Flooring material comprising board shaped floor elements with a rectangular oblong shape, the floor elements made of a base material and comprising edges, a lower side and a decorative upper surface, the floor elements comprising a core to which an upper decorative layer has been applied, the decorative upper surface comprising the upper decorative layer, wherein the flooring material further comprises joining profiles, the joining profiles being separate from the base material of the floor element, wherein the edges and joining profiles allow for two of the floor elements to become mutually fixed adjacent to each other at their respective adjacent edges, such that a horizontal fixation as well as vertical fixation is effective, wherein the horizontal fixation prevents the moving apart of the adjacent floor elements in a horizontal direction when in an installed configuration, wherein the respective adjacent edges comprise each a respective groove, the respective grooves defining a common cavity, wherein the vertical fixation is obtained through at least one of the joining profiles, the at least one of the joining profiles being at least partly located in the cavity, wherein the at least one of the joining profiles includes an upper lateral edge that is chamfered or rounded, wherein the flooring material at the edges further comprises lips and downwardly open grooves formed at the lower side and being parallel to the respective edges, wherein the horizontal fixation is obtained through an interaction of the lips and grooves formed at the lower side, wherein the edges with the downwardly open grooves, comprise a section, located between the edge and the downwardly open groove, which is of a thickness that is thinner than a largest thickness of the floor elements, through a recess located on the lower surface.

15. The flooring material of claim 13 or claim 14, wherein the floor elements have a thickness of between 5 and 15 millimeters.

16. The flooring material of claim 13 or claim 14, wherein the at least one of the joining profiles is not involved in the horizontal fixation.

17. The flooring material of claim 13 or claim 14, wherein the at least one of the joining profiles comprises gripping hooks at its upper surface.

18. The flooring material of claim 13 or claim 14, wherein the respective adjacent edges and the at least one of the joining profiles are located at adjacent short ends of the floor elements.

* * * * *